US010194749B1

(12) United States Patent
Doolan et al.

(10) Patent No.: US 10,194,749 B1
(45) Date of Patent: Feb. 5, 2019

(54) PORTABLE CHAIR AND METHODS OF FORMING A PORTABLE CHAIR

(71) Applicant: YETI Coolers, LLC, Austin, TX (US)

(72) Inventors: William S. Doolan, Dripping Springs, TX (US); Steve Charles Nichols, Austin, TX (US); Roy Joseph Seiders, Rollingwood, TX (US)

(73) Assignee: YETI Coolers, LLC, Austin, TX (US)

( * ) Notice: Subject to any disclaimer, the term of this patent is extended or adjusted under 35 U.S.C. 154(b) by 71 days.

(21) Appl. No.: 15/602,841

(22) Filed: May 23, 2017

(51) Int. Cl.

| | |
|---|---|
| ***A47C 31/00*** | (2006.01) |
| ***A47C 4/30*** | (2006.01) |
| ***A47C 5/02*** | (2006.01) |
| ***A47C 4/34*** | (2006.01) |
| ***A47C 4/44*** | (2006.01) |
| ***A47C 5/10*** | (2006.01) |

(52) U.S. Cl.
CPC ..... *A47C 4/30* (2013.01); *A47C 4/34* (2013.01); *A47C 4/44* (2013.01); *A47C 5/02* (2013.01); *A47C 5/10* (2013.01)

(58) Field of Classification Search
CPC ..... A47C 7/282; B29L 2031/443; Y10T 29/49867
See application file for complete search history.

(56) References Cited

U.S. PATENT DOCUMENTS

| | | | |
|---|---|---|---|
| 2,638,970 | A | 5/1953 | Harber |
| D220,908 | S | 6/1971 | Smith |
| 3,695,702 | A | 10/1972 | Ingellis |
| 3,719,389 | A | 3/1973 | Burton et al. |
| 4,119,286 | A | 10/1978 | Barril |
| 4,234,226 | A | 11/1980 | Colby |
| 4,382,648 | A | 5/1983 | Propst et al. |
| 4,469,377 | A | 9/1984 | O'Rourke |
| 4,513,347 | A | 4/1985 | Wilcox et al. |
| 4,535,923 | A | 8/1985 | Manke |

(Continued)

FOREIGN PATENT DOCUMENTS

| | | |
|---|---|---|
| CN | 3463190 | 7/2005 |
| CN | 301324411 | 8/2010 |

(Continued)

OTHER PUBLICATIONS

Aug. 3, 2018—ISR and WO—App. No. PCT/US18/34040.

(Continued)

*Primary Examiner* — Shin H Kim
(74) *Attorney, Agent, or Firm* — Banner & Witcoff, Ltd.

(57) ABSTRACT

A portable chair may include a first front leg and a second front leg connected by a front sled and a first back leg and a second back leg connected by a back sled. The front sled may include a first front foot and a second front foot and the back sled may include a first back foot and a second back foot. Each of the feet attached to the front and back sleds may include retention feature holes configured to allow water to drain from the sled/foot interface. The portable chair may further include a seat including a seat frame border including a plurality of protrusions. The seat frame border may be rigidly attached to the seat via an injection molding process. The portable chair may also include a seat frame to which the plurality of protrusions of the seat frame border is configured to be removably attached.

20 Claims, 11 Drawing Sheets

(56) References Cited

U.S. PATENT DOCUMENTS 4,613,185 A * 9/1986 Marchesini ..... A47C 4/20 297/39
4,652,050 A 3/1987 Stevens
4,685,255 A 8/1987 Kelley
4,832,152 A 5/1989 Schuelke et al.
4,842,335 A 6/1989 Wunderlich
4,878,642 A 11/1989 Kirby, Jr.
4,914,873 A 4/1990 Newhouse
5,058,347 A 10/1991 Schuelke et al.
5,129,202 A 7/1992 Payne et al.
5,142,734 A 9/1992 Looman et al.
5,174,086 A 12/1992 Payne et al.
D333,387 S 2/1993 Guay
5,211,687 A 5/1993 Loser
5,423,151 A 6/1995 Caro et al.
5,564,779 A 10/1996 Tolbert et al.
D378,476 S 3/1997 Spaeth
5,666,888 A 9/1997 Dame et al.
5,678,890 A 10/1997 Tenbroeck
5,711,575 A 1/1998 Hand et al.
5,762,403 A 6/1998 Robinson
5,911,478 A 6/1999 Goodman
D417,561 S 12/1999 Liu
6,000,752 A 12/1999 Shyr
6,035,901 A 3/2000 Stumpf et al.
6,059,368 A 5/2000 Stumpf et al.
6,062,648 A * 5/2000 Adler ..... A47C 4/02 297/42
D429,969 S 8/2000 Frankel
6,125,521 A 10/2000 Stumpf et al.
6,167,665 B1 1/2001 Dame et al.
6,226,849 B1 5/2001 Beck et al.
6,293,624 B1 9/2001 Gaylord et al.
6,295,764 B1 10/2001 Berridge et al.
6,364,409 B1 * 4/2002 Saul ..... A47C 4/286 297/16.2
6,386,634 B1 5/2002 Stumpf et al.
6,439,659 B1 8/2002 Neubauer, Jr.
6,439,665 B1 8/2002 Cvek
6,502,902 B1 1/2003 Romero
D470,727 S 2/2003 Bartley
6,540,950 B1 * 4/2003 Coffield ..... A47C 7/282 156/245
6,550,855 B2 4/2003 Liu
6,581,260 B2 6/2003 Kinney
D476,860 S 7/2003 Groendyke
6,588,836 B1 7/2003 Lo
6,588,842 B2 7/2003 Stumpf et al.
6,702,390 B2 3/2004 Stumpf et al.
6,718,717 B2 4/2004 Henderson et al.
6,722,741 B2 4/2004 Stumpf et al.
6,726,285 B2 4/2004 Caruso et al.
6,726,286 B2 4/2004 Stumpf et al.
D490,251 S 5/2004 Lin
6,733,080 B2 5/2004 Stumpf et al.
6,764,132 B1 7/2004 Gaertner
D494,769 S 8/2004 Vigneaud
6,890,030 B2 5/2005 Wilkerson et al.
D507,424 S 7/2005 Rogasis
6,942,300 B2 9/2005 Numa et al.
6,955,402 B2 10/2005 VanDeRiet et al.
6,966,604 B2 11/2005 Stumpf et al.
D517,822 S 3/2006 Grosfillex
D519,292 S 4/2006 Ashby
7,052,081 B2 5/2006 Leng
7,059,682 B2 6/2006 Caruso et al.
7,066,550 B1 6/2006 Su
7,249,802 B2 7/2007 Schmitz et al.
D555,371 S 11/2007 Le Gal
D559,000 S 1/2008 Vanderminden, Sr.
D571,115 S 6/2008 Cohen
D580,689 S 11/2008 Su
7,455,365 B2 11/2008 Caruso et al.
D581,708 S 12/2008 Su
7,472,962 B2 1/2009 Caruso et al.
7,537,453 B2 5/2009 Morgan et al.
D599,127 S 9/2009 Smith
7,594,700 B2 9/2009 Stumpf et al.
7,654,616 B2 2/2010 Kinoshita et al.
7,654,617 B2 2/2010 Farnsworth
7,765,663 B2 8/2010 Liu
7,794,022 B2 9/2010 Caruso et al.
7,841,666 B2 11/2010 Schmitz et al.
D633,311 S 3/2011 Peguero
D639,577 S 6/2011 Tseng
8,029,066 B2 10/2011 Su
8,033,598 B2 10/2011 Smith et al.
D648,554 S 11/2011 Smith
D648,962 S 11/2011 Brodbeck
D651,010 S 12/2011 Cohen
D654,322 S 2/2012 Duncan
8,109,576 B2 2/2012 Lin
D660,612 S 5/2012 Smith
8,172,332 B2 5/2012 Masunaga et al.
8,240,771 B2 8/2012 Diffrient
8,267,469 B1 * 9/2012 Adan ..... A47C 4/28 297/44
8,282,172 B2 10/2012 Schmitz et al.
D672,161 S 12/2012 McDowell
D673,816 S 1/2013 Phillips
8,449,037 B2 5/2013 Behar et al.
8,616,655 B2 12/2013 Jung
8,657,521 B2 2/2014 Reeves
8,801,102 B2 8/2014 Broome et al.
8,851,561 B2 10/2014 Huang
9,003,635 B2 4/2015 Parker et al.
9,033,410 B2 5/2015 Roani et al.
9,033,421 B2 5/2015 Wilkinson et al.
9,161,629 B2 10/2015 Huang
9,211,014 B2 12/2015 Schmitz et al.
9,414,673 B2 8/2016 Behar et al.
9,462,891 B2 10/2016 Kikuchi et al.
D771,400 S 11/2016 DoVale
9,492,014 B1 11/2016 Smith et al.
9,668,580 B2 6/2017 Schmitz et al.
9,877,587 B2 1/2018 Grace
D811,143 S 2/2018 Chavarria
2001/0033100 A1 10/2001 Haney
2002/0142904 A1 10/2002 Zumbiel
2003/0071509 A1 4/2003 Neil et al.
2004/0251718 A1 12/2004 Degen et al.
2006/0138849 A1 6/2006 Wilkerson et al.
2006/0163934 A1 7/2006 Chen
2006/0170255 A1 8/2006 Huang
2007/0170756 A1 7/2007 Kang
2008/0001329 A1 * 1/2008 Vannimwegen .... B29B 17/0042 264/320
2008/0006965 A1 1/2008 Hsien
2008/0272640 A1 * 11/2008 Boyle ..... A47C 1/143 297/463.1
2009/0100587 A1 4/2009 Smith
2009/0261644 A1 10/2009 Piretti
2012/0149263 A1 6/2012 Cvek
2013/0069414 A1 3/2013 Ko
2015/0173514 A1 * 6/2015 Kikuchi ..... A47C 31/02 297/451.9
2015/0308171 A1 10/2015 Shadley

FOREIGN PATENT DOCUMENTS

CN 301377966 11/2010
CN 303501418 12/2015
EP 002735472-0004 7/2015
JP 2002-142904 A 5/2002

OTHER PUBLICATIONS

Website: Toys"R"Us, "Quinny Stroller Cupholder," visited Jan. 5, 2017, <https://t.toysrus.com/product?productid=17078546>.

Website: Cheeky Rascals, Image/jpg of "Mima Accessory Cup Holder," visited Jan. 5, 2017, <http://images.cheekyrascals.co.uk/images/product_shots/mima/mima_accessory_cup_holder.jpg>.

(56) References Cited

OTHER PUBLICATIONS

Website: 93y.ru., "Surf Silver Cross,"visited Jan. 5, 2017, <http://93y.ru/223101-podstakannik-surf-silver-cross.html>.
Website: Linio, "Portavasos de Bicicleta, Motocicleta y Carreolas," visited Jan. 5, 2017, <https://www.linio.com.mx/p/portavasos-de-bicicleta-motocicleta-y-carreolas-tmqk8f>.
Website: Adverts, "Bugaboo Cup Holder," visited Jan. 5, 2017, <http://www.adverts.ie/buggies/bugaboo-cup-holder/9897502>.
Website: Babyhome, "Cup Holder," visited Jan. 5, 2017, <http://babyhome.es/qa/en/products/cup-holder>.
Website: Overstock, "Caravan Canopy Blue Suspension Folding Chair," visited Jan. 31, 2018, <https://www.overstock.com/Sports-Toys/Caravan-Canopy-Blue-Suspension-Folding-Chair/8789499/product.html>.
Website: Verified Designs, "Mesh Patio Chairs with Folding Chairs Ideas And Metal Chairs Materials," visited Jan. 31, 2018, <http://verifieddesigns.com/spectacular-mesh-patio-chair-design-which-is-more-embellishing-you-home-space/mesh-patio-chairs-with-folding-chairs-ideas-and-metal-chairs-materials/>.
Website: Jet, "Westfield Outdoor S13-S998T FS Tan FLD Sling Chair," visited Jan. 31, 2018, <https://jet.com/product/Westfield-Outdoor-S13-S998T-FS-Tan-FLD-Sling-Chair/0fbe30d483a248478b79e3bce8d22928>.
Website: Sun Prairie Blues Fest, "Reclining Patio Chair with Pull Out Ottoman," visited Jan. 31, 2018, http://family.spbluesfest.com/foldable-reclining-patio-chair-lounge/reclining-patio-chair-with-pull-out-ottoman/.

* cited by examiner

PORTABLE CHAIR AND METHODS OF FORMING A PORTABLE CHAIR

FIELD

Aspects described herein generally relate to portable chairs. More specifically, aspects relate to portable and collapsible chairs.

BACKGROUND

Portable chairs are commonly used during events and activities where seating is desirable, but not always provided, such as tailgating, camping, and outdoor barbeques. In most cases, however, such chairs are made with cheap, low-end materials that provide for an uncomfortable seating experience, poor durability, minimal long-term viability, and susceptibility to accelerated deterioration under exposure to environmental phenomena. Accordingly, overall user satisfaction with low-end portable chairs is low and the frequency of replacement is high.

In other cases in which higher quality materials are used in the manufacture of portable chairs, extended longevity may be achievable as compared to low-end offerings. However, such high-end chairs exhibit marginal improvements in comfortability, resistance to weather-induced deterioration, and overall durability, while being offered at a substantially higher price point.

Accordingly, there exists a need for high quality, comfortable, and durable portable chairs.

BRIEF SUMMARY

The following presents a simplified summary of various aspects described herein. This summary is not an extensive overview, and is not intended to identify key or critical elements or to delineate the scope of the claims. The following summary merely presents some concepts in a simplified form as an introductory prelude to the more detailed description provided below.

To overcome limitations in the prior art described above, and to overcome other limitations that will be apparent upon reading and understanding the present specification, aspects described herein are directed to a portable chair and methods of forming a portable chair.

In accordance with one or more embodiments, a portable chair may include a first front leg and a second front leg connected by a front sled and a first back leg and a second back leg connected by a back sled. The front sled may include a first front foot and a second front foot and the back sled may include a first back foot and a second back foot. Each of the feet attached to the front and back sleds may include retention feature holes configured to allow water to drain from the sled/foot interface. The portable chair may further include a seat of a highly-permeable, weave-type construction which may include a seat frame border. The seat frame border may be a rigid thermoplastic over-mold including a plurality of protrusions on an underside portion. The seat frame border may be rigidly attached to the seat via an injection molding process which may form the plurality of protrusions. The portable chair may also include a seat frame including a first terminal end, a second terminal end, a first seat attachment rail, and a second seat attachment rail. The plurality of protrusions on the underside portion of the seat frame border may be configured to removably engage with the first seat attachment rail and the second seat attachment rail. Additionally, the seat frame may include a carrying handle.

In some embodiments, in a state in which the seat frame border of the seat is removably engaged with the first seat attachment rail and the second seat attachment rail, the seat may be configured to slope downward at a front end portion.

In some embodiments, the portable chair may further include a first front leg joinery interface including a tubular protrusion onto which the first front leg may be configured to be inserted and fastened onto via a structural adhesive. The portable chair may also include a first back leg joinery interface including a tubular protrusion onto which the first back leg may be configured to be inserted and fastened onto via a structural adhesive.

In some embodiments, the portable chair may further include a first arm rest that may be configured to be rotatably fastened to the first front leg joinery interface and the first back leg joinery interface via a first front pin.

In some embodiments, the portable table chair may further include a second front leg joinery interface including a tubular protrusion onto which the second front leg may be configured to be inserted and fastened onto via a structural adhesive. The portable chair may also include a second back leg joinery interface including a tubular protrusion onto which the second back leg may be configured to be inserted and fastened onto via a structural adhesive.

In some embodiments, the portable chair may further include a second arm rest that may be configured to be rotatably fastened to the second front leg joinery interface and the second back leg joinery interface via a second front pin.

In some embodiments, the portable chair may further include a back of a highly-permeable, weave-type construction which may include a back frame border. The back frame border may be a rigid thermoplastic over-mold including a plurality of protrusions on a backside portion. The back frame border may be rigidly attached to the back via an injection molding process which may form the plurality of protrusions. The portable chair may also include a back frame including a first terminal end, a second terminal end, a first back attachment rail, and a second back attachment rail. The plurality of protrusions on the backside portion of the back frame border may be configured to removably engage with the first back attachment rail and the second back attachment rail.

In some embodiments, the portable chair may further include a first back joinery interface. The first back joinery interface may include a tubular protrusion onto which the first terminal end of the back frame may be configured to be inserted and fastened onto via structural adhesive. The portable chair may also include a second back joinery interface. The second back joinery interface may include a tubular protrusion onto which the second terminal end of the back frame may be configured to be inserted and fastened onto via structural adhesive.

In some embodiments, the portable chair may further include a first seat joinery interface. The first seat joinery interface may include a tubular protrusion onto which the first terminal end of the seat frame may be configured to be inserted and fastened onto via structural adhesive. The portable chair may also include a second seat joinery interface. The second seat joinery interface may include a tubular protrusion onto which the second terminal end of the seat frame may be configured to be inserted and fastened onto via structural adhesive.

In some embodiments, each of the first front leg, second front leg, front sled, first back leg, second back leg, back sled, seat frame, and back frame may be composed of hydroformed aluminum.

These features, along with many others, are discussed in greater detail below.

BRIEF DESCRIPTION OF THE DRAWINGS

A more complete understanding of aspects described herein and the advantages thereof may be acquired by referring to the following description in consideration of the accompanying drawings, in which like reference numbers indicate like features, and wherein.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "top," "bottom," "front," "back," "side," "rear," "upward," "downward," right, left, and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

Overview of Chair

Figure 1:
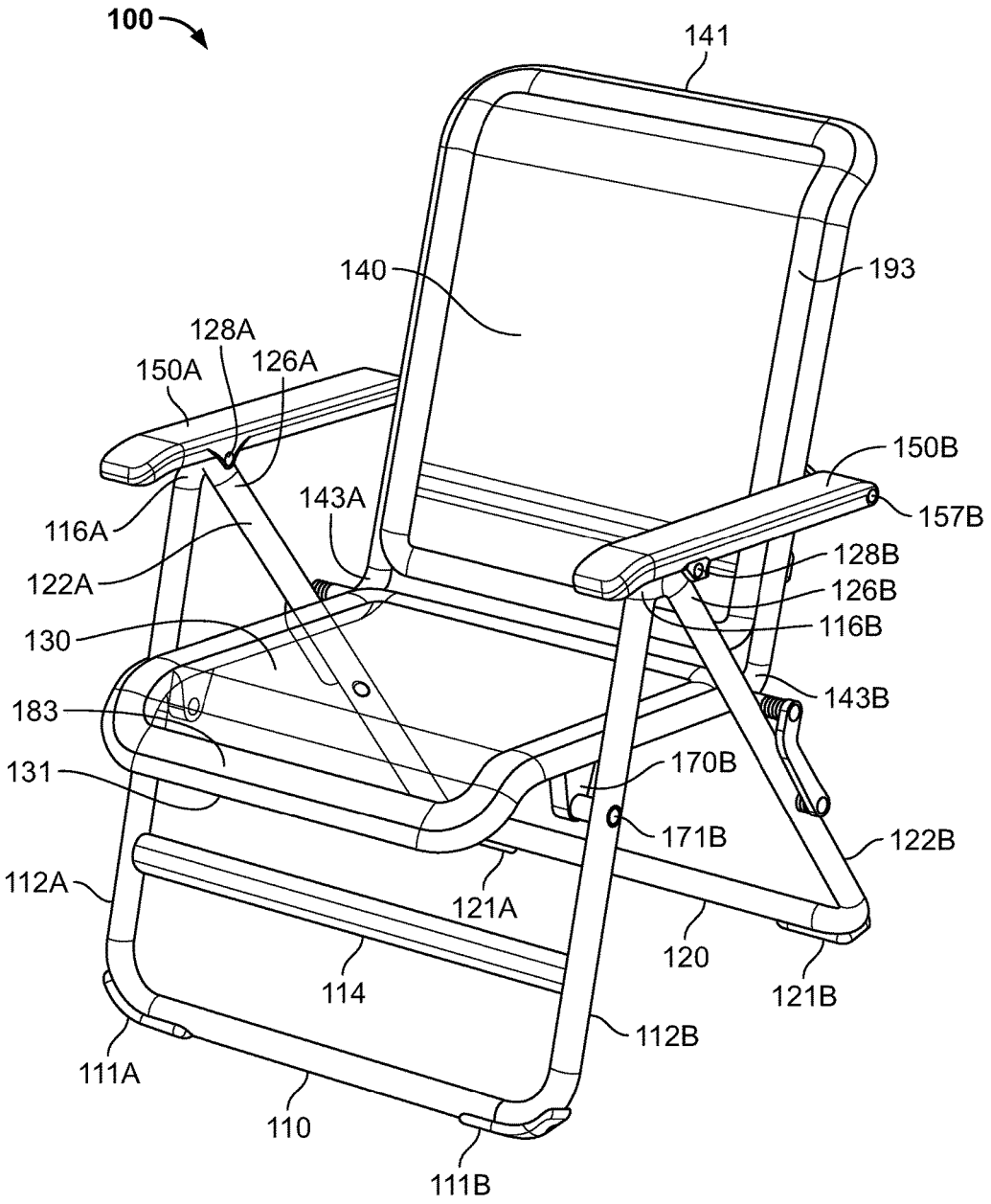
FIG. 1 is a front prospective view of an example of a portable chair according to one or more aspects described herein.

FIG. 1 depicts a front prospective view of an example of a chair 100, which can be a foldable and portable chair. Chair 100 may include a front sled 110 connecting front legs 112A and 112B and a back sled 120 connecting back legs 122A and 122B. The front sled 110 and the back sled 120 may be configured to support the chair 100 on a surface. The front legs 112A and 112B may be further connected and reinforced by front crossbar 114. The chair 100 may also include seat 130 connected to seat frame 131, and a back 140 connected to back frame 141. The chair 100 may include arm rests 150A and 150B. As will be discussed in further detail below, the chair 100 can be configured to fold up into a smaller profile for ease of storage and transportability.

Additionally, chair 100 may be of a symmetric construction wherein components on a left side of chair 100 (e.g., side corresponding to arm rest 150B) are mirrored on a right side (e.g., side corresponding to arm rest 150A). As such, front leg 112B may correspond to front leg 112A, arm rest 150B may correspond to arm rest 150A, and so on. Furthermore, as will be described in further detail below, components of chair 100 such as seat frame 131 and back frame 141, which extend from the left side to the right side of chair 100, may also be of a symmetric construction. For instance, seat frame 131 may include a first seat attachment rail on the left side and second seat attachment rail on the right side, back frame 141 may include a first back attachment rail on the left side and a second back attachment rail on the right side, and so on.

Legs

The portable chair 100 may include two front legs 112A and 112B and two back legs 122A and 122B. The two front legs 112A and 112B and the two back legs 122A and 122B may be cylindrical rods, tubes, and/or shafts and may be made of, for example, aluminum, titanium, stainless steel, scandium, metal alloys, polymers, composites, carbon fiber, and/or wood, such as bamboo. In instances in which aluminum, titanium, stainless steel, scandium, and/or metal alloys are used in the fabrication of the two front legs 112A and 112B and the two back legs 122A and 122B, the metals may be hydroformed and vacuum casted and may be treated through anodizing, plating, painting, powder coating, and/or the application of enamel in order to prevent corrosion induced by environmental conditions such as salt spray. Additionally, the metals and alloys used in the fabrication of legs 112A, 112B, 122A, and 122B may be treated through annealing, case hardening, precipitation strengthening, tempering, normalizing, and/or quenching in order to increase hardness, toughness, and tensile and shear strength.

The front legs 112A and 112B of portable chair 100 may be connected by front crossbar 114. Front crossbar 114 may be made of the same material as that of front legs 112A and 112B (e.g., aluminum, titanium, stainless steel, scandium, metal alloys, carbon fiber, and/or bamboo) or may be made of a different material than that of front legs 112A and 112B. In instances in which front legs 112A and 112B are made of a metal and front crossbar 114 is also made of a metal, front crossbar 114 may be welded to an inner portion of front legs 112A and 112B. Alternatively, front legs 112A and 112B and front crossbar 114 may be fabricated in a single continuous piece in a molding operation. In such instances, the fabrication may be done through hydroforming. Similarly, in instances in which front legs 112A and 112B are made of carbon fiber and front crossbar 114 is also made of carbon fiber, front legs 112A and 112B and front crossbar 114 may be fabricated in a single continuous piece in a molding operation. However, it is also contemplated that front crossbar 114 may be screwed, bolted, clamped, or otherwise fastened to an inner portion of front legs 112A and 112B, for example, in instances in which front legs 112A and 112B are made of a different material than that of front crossbar 114. Front crossbar 114 may be a low flex and low creep member and may able to support up to a 5001*b* applied load. While not shown in FIG. 1, in some instances the back legs 120A and 120B of portable chair 100 may be connected by a back crossbar in a manner similar to the arrangement described above regarding front legs 110A and 110B and front crossbar 114.

In some embodiments, combinations of different materials can be used to form the chair 100. For example, front legs 110A and 110B and front crossbar 114 may be made of a different material than that of back legs 120A and 120B. For example, front legs 110A and 110B and front crossbar 114 may be made of carbon fiber and back legs 120A and 120B may be made of metal. Alternatively, front legs 110A and 110B and back legs 120A and 120B may be made of a first material (e.g., metal) and front crossbar 114 may be made of a second material (e.g., carbon fiber).

In arrangements in which a back crossbar is included, similar combinations of different materials as described above may be used to form the chair 100. For example, front legs 110A and 110B and front crossbar 114 may be made of a different material than that of back legs 120A and 120B and the back crossbar. For example, front legs 110A and 110B and front crossbar 114 may be made of carbon fiber and back legs 120A and 120B and the back crossbar may be made of metal. Alternatively, front legs 110A and 110B and back legs 120A and 120B may be made of a first material (e.g., metal) and front crossbar 114 and the back crossbar may be made of a second material (e.g., carbon fiber).

Sleds and Feet

The two front legs 112A and 112B may be joined by front sled 110, which may be a continuous connecting member. As such, the two front legs 112A and 112B and the front sled 110 may be fabricated in a single continuous piece through, for example, any of the manufacturing methods described herein. Similarly, the two back legs 122A and 122B may be joined by back sled 120 and may be fabricated in a single continuous piece. The front sled 110 and the back sled 120 may be treated through anodizing, plating, painting, powder coating, and/or the application of enamel in order to prevent corrosion induced by environmental conditions such as salt spray, as well as through annealing, case hardening, precipitation strengthening, tempering, normalizing, and/or quenching in order to increase hardness, toughness, and tensile and shear strength.

Figure 2A:
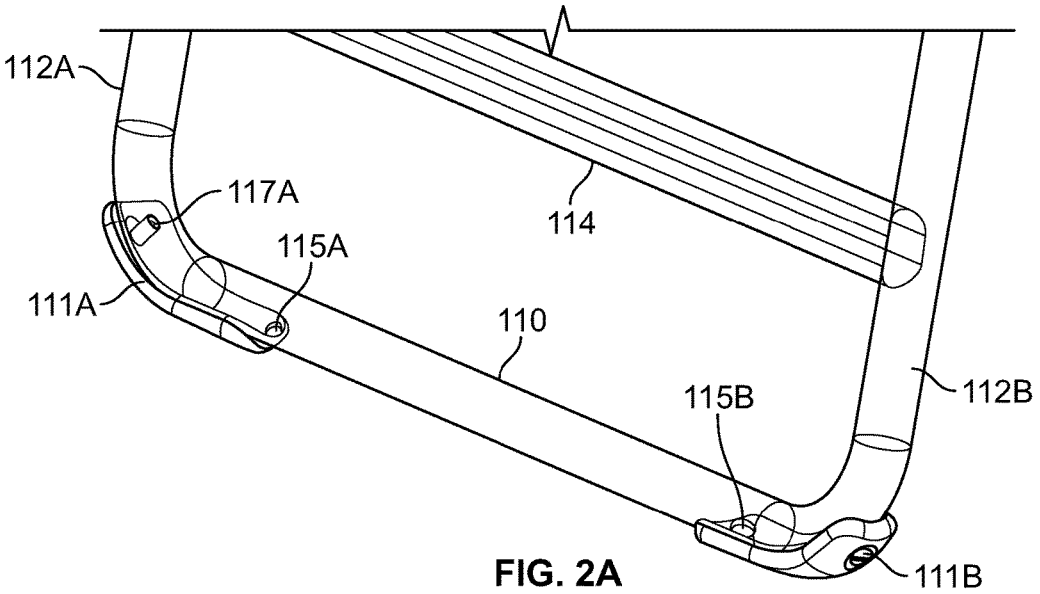
FIGS. 2A, 2B, and 2C respectively illustrate front perspective views of example sections of the example portable chair of FIG. 1 according to one or more aspects described herein.
Figure 2B:
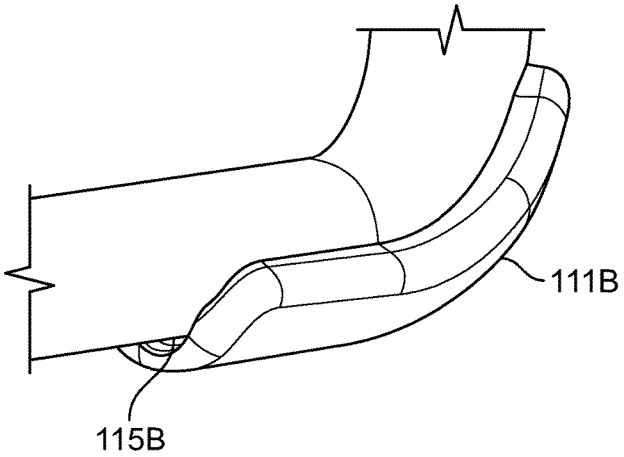
Figure 2C:
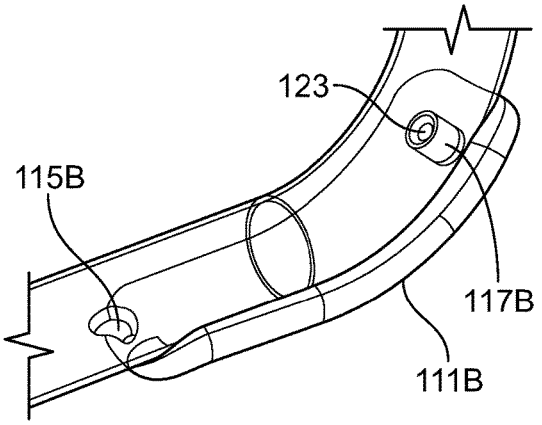

Additionally, the front sled 110 may include front foot 111A and front foot 111B, which may be plastic and/or rubber caps at a lowermost and/or bottommost portion of sled 110 to facilitate or improve the frictional engagement with an adjacent contact surface (e.g., floor, ground, etc.). The front feet can include a suitable material or texture to increase the coefficient of friction between the front feet and the surface which the chair is placed. As shown in FIGS. 2A, 2B, and 2C, front feet 111A and 111B may be configured to engage with a section of front sled 110 proximate to the front legs 112A and 112B. As such, front foot 111A may be configured to engage with a section of front sled 110 proximate to front leg 112A and front foot 111B may be configured to engage with a section of front sled 110 proximate to front leg 112B.

As shown in FIG. 2C, front foot 111B may include engagement plug 117B. In some instances, engagement plug 117B may be a plastic, rubber, and/or metal protrusion extending radially from front foot 111B. Additionally and/or alternatively, engagement plug 117B may be a screw-like structure made of plastic, rubber, and/or metal. The engagement plug 117B may be configured to be inserted into front sled 110. Before, during, or after insertion, a binding agent and/or structural adhesive may be applied to engagement plug 117B to secure front foot 111B to front sled 110. Additionally, front foot 111B may include retention feature hole 115B which may be configured to allow water to drain away from the foot/sled interface. Similar to front foot 111B, front foot 111A may include an engagement plug 117A and a retention feature hole 115A, each of which may be configured to interface with sled 110 and function in the manner described in regard to front foot 111B.

Also the engagement plugs 117A, 117B can each include a series of holes 123, which provide a channel for moisture located in the frame. The series of holes 123 in combination with the retention feature holes 115A, 115B create an outlet for any moisture that collects inside the frame of the chair. In one example, a single hole or a plurality of holes can be included on the end of the engagement plugs 117A, 117B. In other examples, the engagement plugs 117A, 117B can be formed of a porous material that allows water to flow through the engagement plugs 117A, 117B to allow for water to escape through the retention feature holes 115A, 115B. It is also envisioned that separate holes can be included in the frame and in the front feet 111A, 111B to allow for water or moisture to escape out of the frame of the chair.

In other examples, the front feet 111A and 111B may be plastic and/or rubber coatings applied to front sled 110 and may be included in recessed or notched pockets (not shown) proximate to the two front legs 112A and 112B. Alternatively, the plastic and/or rubber coating may be applied along the length of the front sled 110 at a lowermost and/or bottommost portion and the first and second front engagement faces and may form a continuous front engagement face. In other examples, the plastic and/or rubber coating may be applied intermittently in uniform intervals along the length of the front sled 110 at a lowermost and/or bottommost portion. In such examples, the front feet may form an intermittent front engagement face.

Similar to front sled 110, the back sled 120 may include back foot 121A and back foot 121B, which may be plastic and/or rubber caps at a lowermost and/or bottommost portion to facilitate frictional engagement with an adjacent contact surface (e.g., floor, ground, etc.). Back feet 121A and 121B may be configured to engage with a section of back sled 120 proximate to the back legs 122A and 122B. As such, back foot 121A may be configured to engage with a section of back sled 120 proximate to back leg 122A and back foot 121B may be configured to engage with a section of back sled 120 proximate to back leg 122B.

Similar to front feet 111A and 111B, back feet 121A and 121B may each include an engagement plug and a retention feature hole. The engagement plug and retention feature hole of back feet 121A and 121B may be configured to interface with sled 120 and function in the manner described in regard to front feet 111A and 111B. Also the back feet 121A and 121B can be provided with similar draining features discussed above in relation to front feet 111A and 111B.

Again, in other examples, back feet 121A and 121B may be plastic and/or rubber coatings applied to back sled 120 and may be included in recessed pockets proximate to the two back legs 122A and 122B. Alternatively, the plastic and/or rubber coating may be applied along the length of the back sled 120 at a lowermost and/or bottommost portion and the first and second back engagement faces and may form a continuous back engagement face. In other examples, the plastic and/or rubber coating may be applied intermittently in uniform intervals along the length of the back sled 120 at a lowermost and/or bottommost portion. In such examples, the first and second back engagement faces may form an intermittent back engagement face.

Joinery Interfaces

Figure 3:
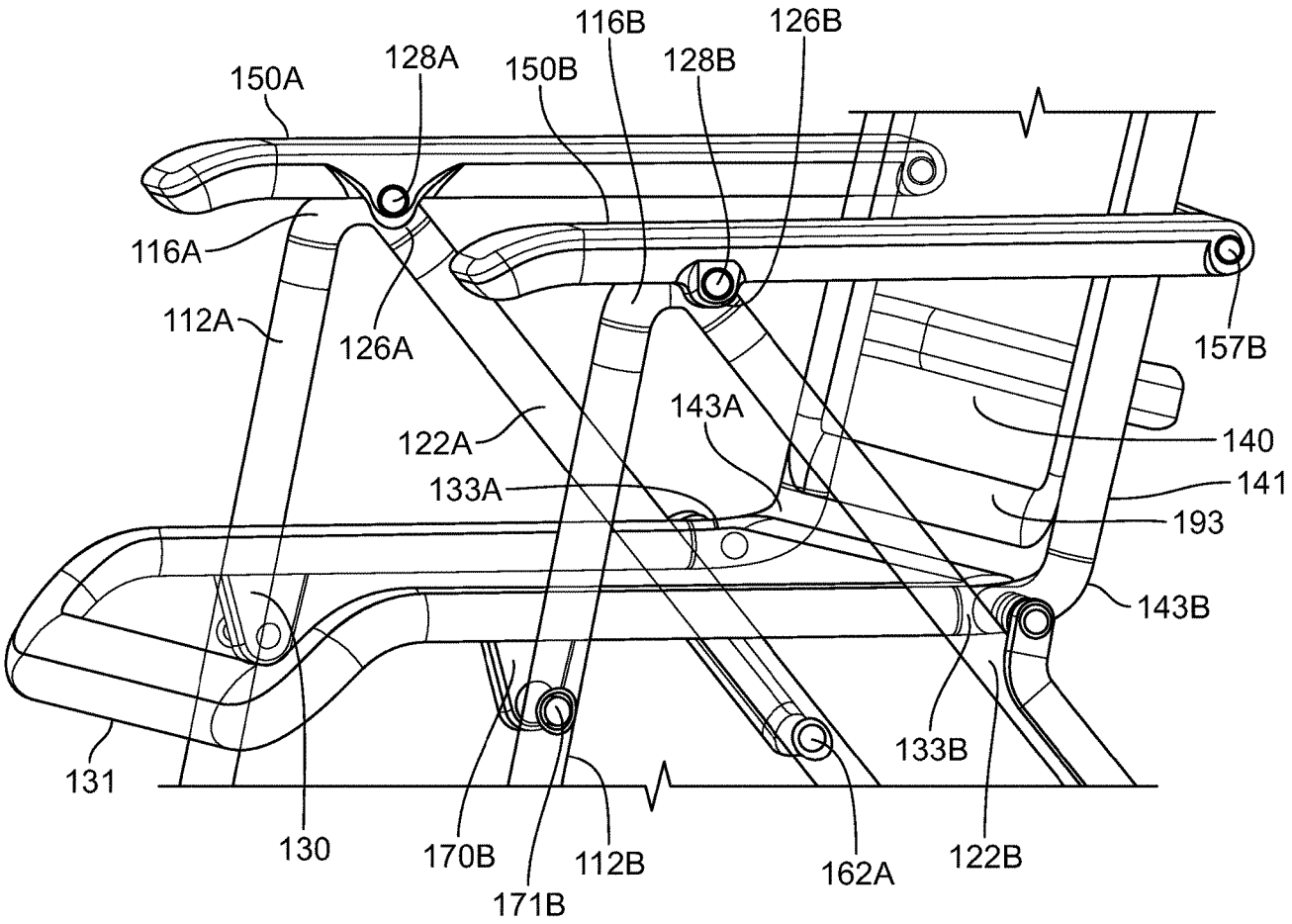
FIG. 3 is a side prospective view of the example portable chair of FIG. 1 according to one or more aspects described herein.

As shown in FIG. 3, at an upper and/or top proximal end portion, front leg 112A may intersect with front leg joinery interface 116A. In particular, front leg joinery interface 116A may include a tubular termination onto which front leg 112A may be configured to be inserted. Before, during, or after insertion, a binding agent and/or structural adhesive may be applied to the tubular termination of front leg joinery interface 116A and/or upper/top proximal end portion of front leg 112A to secure front leg 112A to the front leg joinery interface 116A. Such adhesives may include drying adhesives, pressure sensitive adhesives, contact adhesives, hot adhesives, reactive adhesives, multi-part adhesives, one-part adhesives. The adhesives may be either natural or synthetic and can be based on one or more of thermoplastics, emulsions, or thermosets, including one or more of epoxy, polyurethane, cyanoacrylate, or acrylic polymers. Additionally and/or alternatively, front leg 112A may be welded onto front leg joinery interface 116A.

Front leg 112B may be configured to engage with front leg joinery interface 116B in the manner described in regard to front leg 112A and front leg joinery interface 116A (e.g., adhered and/or welded).

Similarly, at an upper and/or top proximal end portion, back leg 122A may intersect with back leg joinery interface 126A. In particular, back leg joinery interface 126A may include a tubular termination onto which back leg 122A may be configured to be inserted. Before, during, or after insertion, a binding agent and/or structural adhesive as discussed herein may be applied to the tubular termination of back leg joinery interface 126A and/or upper and/or top proximal end portion of back leg 122A to secure back leg 122A to the back leg joinery interface 126A. Additionally and/or alternatively, back leg 122A may be welded onto back leg joinery interface 126A. Back leg 122B may be configured to engage with back leg joinery interface 126B in the manner described in regard to back leg 122A and back leg joinery interface 126A (e.g., adhered and/or welded). Nevertheless, it is also contemplated that the joints discussed herein could be formed by mechanical fastening techniques, such as, friction fits, threads, ball and sockets, bayonet connections, and the like.

In certain arrangements, at an upper and/or top proximal end portion of front leg 112A, the front leg 112A may be bent in a rearward direction at an obtuse angle and may terminate at front leg joinery interface 116A. In some instances, front leg joinery interface 116A may be a continuous upper and/or top terminal end portion of front leg 110A and may be made of the same material as that of front leg 112A (e.g., aluminum, titanium, scandium, metal alloys, carbon fiber, and/or bamboo).

Back leg 122A may extend linearly to an upper and/or top proximal end portion and may terminate at back leg joinery interface 126A. Back leg joinery interface 126A may be a continuous upper and/or top terminal end portion of back leg 122A and may be made of the same material as that of back leg 122A (e.g., aluminum, titanium, scandium, metal alloys, carbon fiber, and/or bamboo).

Front leg joinery interfaces 116A, 116B may be configured to join, interface, and/or otherwise connect with back leg joinery interfaces 126A, 126B. In one example, the front joinery interfaces 116A, 116B and the back joinery interfaces 126A, 126B are configured to pivot about pins 128A, 128B such that the front legs 112A, 112B are configured to pivot relative to the back legs 122A, 122B.

Seat and Seat Frame

Portable chair 100 may include seat 130, which may be removably attached to seat frame 131. Front legs 112A and 112B may be configured to be rotatably joined and/or fastened to front leg attachment portions 170A and 170B, respectively, of seat frame 131 via pins 171A and 171B.

Seat frame 131 may be a cylindrical rod, tube, shaft, and/or extrusion I-beam and may be made of aluminum, titanium, stainless steel, scandium, metal alloys, carbon fiber, and/or bamboo. In instances in which aluminum, titanium, stainless steel, scandium, and/or metal alloys are used in the fabrication of seat frame 131, the material may be hydroformed and vacuum casted and may be treated through anodizing, plating, painting, powder coating, and/or the application of enamel in order to prevent corrosion induced by environmental conditions such as salt spray. Additionally, the metals used in the fabrication of seat frame 131 may be treated through annealing, case hardening, precipitation strengthening, tempering, normalizing, and/or quenching in order to increase hardness, toughness, and tensile and shear strength.

Seat frame 131 may include front leg attachment portions 170A and 170B, which may be configured to facilitate the rotatable attachment of seat frame 131 to front legs 112A and 112B, respectively, by way of pins 171A and 171B. Additionally, seat frame 131 may intersect with seat joinery interfaces 133A and 133B. In particular, seat joinery interfaces 133A and 133B may include tubular terminations onto which seat frame 131 may be configured to be inserted. Before, during, or after insertion, a binding agent and/or structural adhesive as discussed herein may be applied to the tubular terminations of seat joinery interfaces 133A and 133B and/or terminal ends of seat frame 131 to secure the seat frame 131 to the seat joinery interfaces 133A and 133B.

As shown in FIGS. 4B, 5A, 7A, and 7B, seat frame 131 may include carrying handle 172. Carrying handle 172 may be a front over-mold fixing extrusion that extends from an inner face of seat frame 131. The handle 172 may double as a large, easy-grip carry handle for carrying chair 100. Carrying handle 172 may be positioned on an inner face of a front portion of seat frame 131 and may be made of the same material as that of seat frame 131 (e.g., aluminum, titanium, stainless steel, scandium, metal alloys, carbon fiber, and/or bamboo). As such, carrying handle 172 may be manufactured as a continuous piece of seat frame 131. Thus, in instances in which aluminum, titanium, stainless steel, scandium, and/or metal alloys are used in the fabrication of seat frame 131 and carrying handle 172, the material may be hydroformed and vacuum casted and into seat frame 131 and carrying handle 172 and may be treated through anodizing, plating, painting, powder coating, and/or the application of enamel in order to prevent corrosion induced by environmental conditions such as salt spray. Additionally, the metals used in the fabrication of seat frame 131 and carrying handle 172 may be treated through annealing, case hardening, precipitation strengthening, tempering, normalizing, and/or quenching in order to increase hardness, toughness, and tensile and shear strength.

Alternatively, carrying handle 172 may not form a continuous piece with seat frame 131 and, as such, may be a separate component. In such instances, carrying handle 172 may be made of either the same material as that of seat frame 131, or may be made of a different material. In either event, carrying handle 172 may be attached to seat frame 131 via adhesion, welding, mechanical fastening (e.g., nut and bolt), and the like.

First Embodiment of Seat/Seat Frame Engagement

Figure 4A:
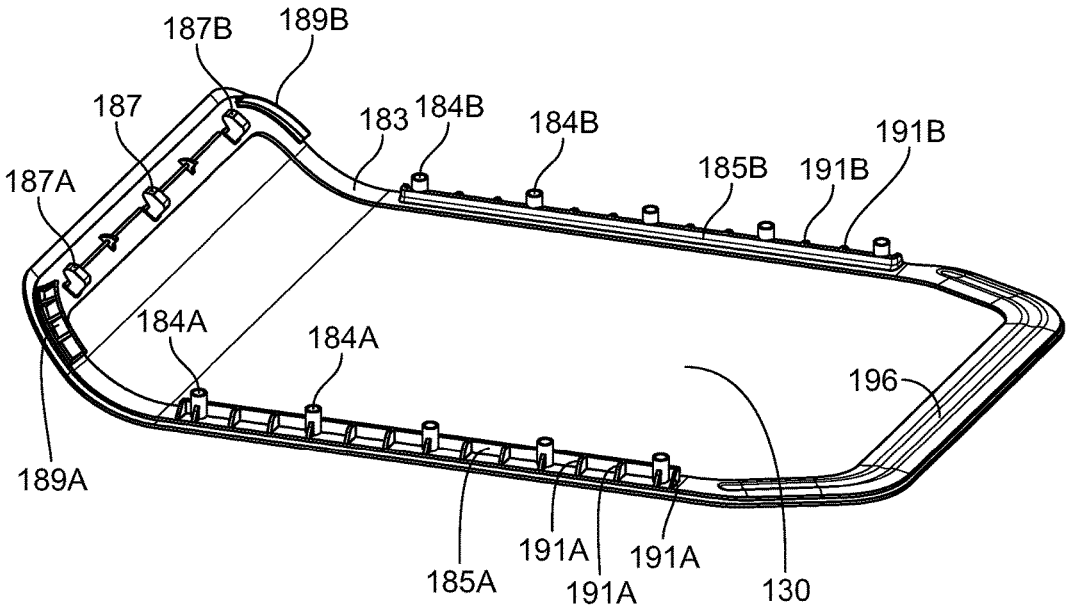
FIGS. 4A, 4B, 4C, and 4D respectively illustrate an underside prospective view of a first example seat, a top prospective view of a first example seat frame, a sectional view of the first example seat engaged with the first example seat frame, and an exploded view of components of the first example seat and the first example seat frame of the example portable chair of FIG. 1 according to one or more aspects described herein.
Figure 4B:
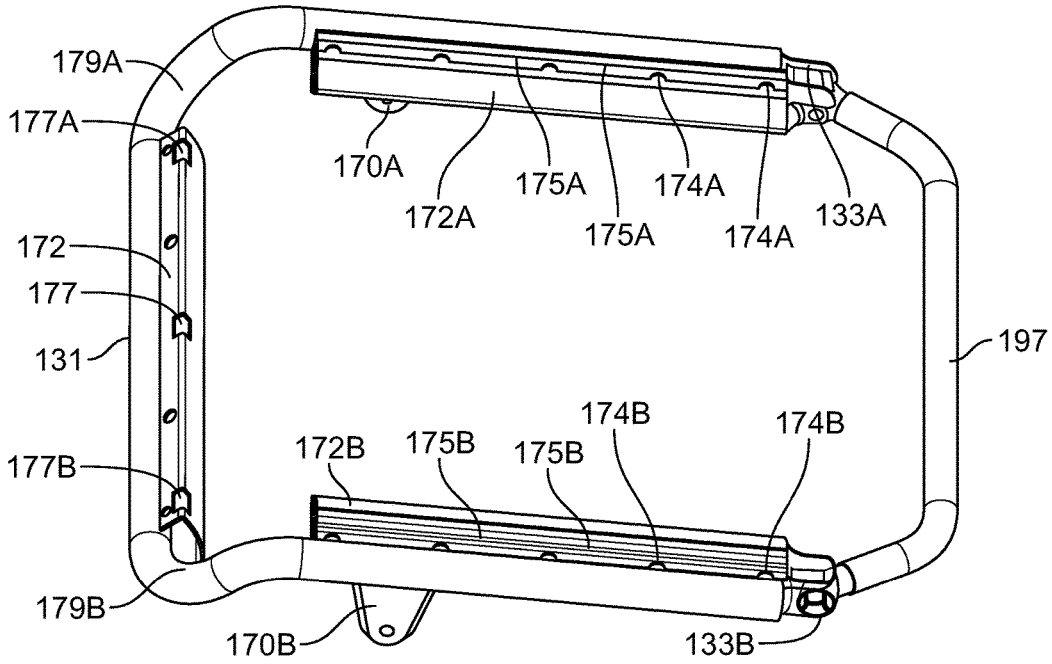

According to a first embodiment of the seat/seat frame engagement and as shown in FIG. 4B, carrying handle 172 may include front attachment hole 177B on a first side of carrying handle 172 (e.g., left side of carrying handle 172), front attachment hole 177A on a second side of carrying handle 172 (e.g., right side of carrying handle 172), and front attachment hole 177 on a third side of carrying handle 172 (e.g., center of carrying handle 172). As will be described in further detail below, front attachment holes 177, 177A, and 177B may be respectively configured to engage with front attachment clips 187, 187A, and 187B of seat 130.

Furthermore, seat frame 131 may also include seat attachment rail 172B. Seat attachment rail 172B may be positioned on an inner face of a side portion of seat frame 131 proximate to arm rest 150B, front leg 112B, and the like. Seat attachment rail 172B may be made of the same material as that of seat frame 131 (e.g., aluminum, titanium, stainless steel, scandium, metal alloys, carbon fiber, and/or bamboo). As such, seat attachment rail 172B may be manufactured as a continuous piece of seat frame 131. Thus, in instances in which aluminum, titanium, stainless steel, scandium, and/or metal alloys are used in the fabrication of seat frame 131 and seat attachment rail 172B, the material may be hydroformed and vacuum casted and into seat frame 131 and seat attachment rail 172B and may be treated through anodizing, plating, painting, powder coating, and/or the application of enamel in order to prevent corrosion induced by environmental conditions such as salt spray. Additionally, the metals used in the fabrication of seat frame 131 and seat attachment rail 172B may be treated through annealing, case hardening, precipitation strengthening, tempering, normalizing, and/or quenching in order to increase hardness, toughness, and tensile and shear strength.

Alternatively, seat attachment rail 172B may not form a continuous piece with seat frame 131 and, as such, may be a separate component. In such instances, seat attachment rail 172B may be made of either the same material as that of seat frame 131, or may be made of a different material. In either event, seat attachment rail 172B may be attached to seat frame 131 via adhesion, welding, mechanical fastening (e.g., nut and bolt), and the like.

Seat attachment rail 172B may include rib engagement channels and a plurality of side attachment holes. For example, as shown in FIG. 4B, seat attachment rail 172B may include rib engagement channels 175B and side attachment holes 174B. Rib engagement channels 175B may run along the entirety of the length of seat attachment rail 172B. Rib engagement channels 175B may be configured to support side ribs 185B and flanges 191B of seat 130. A plurality of side attachment holes 174B may be positioned on the rib engagement channels 175B. Each of the side attachment holes 174B may be configured to receive a side attachment screw interface 184B of seat 130. While five side attachment holes 174B are depicted in FIG. 4B, a fewer number (e.g., one, two, three, or four) or a greater number (six, ten, etc.) of side attachment holes 174B may be included.

Seat frame 131 may also include seat attachment rail 172A. Seat attachment rail 172A may be positioned on an inner face of a side portion of seat frame 131 proximate to arm rest 150A, front leg 112A, and the like. Seat attachment rail 172A may be made of the same material as that of seat frame 131 (e.g., aluminum, titanium, stainless steel, scandium, metal alloys, carbon fiber, and/or bamboo). As such, seat attachment rail 172A may be manufactured as a continuous piece of seat frame 131. Thus, in instances in which aluminum, titanium, stainless steel, scandium, and/or metal alloys are used in the fabrication of seat frame 131 and seat attachment rail 172A, the material may be hydroformed and vacuum casted and into seat frame 131 and seat attachment rail 172A and may be treated through anodizing, plating, painting, powder coating, and/or the application of enamel in order to prevent corrosion induced by environmental conditions such as salt spray. Additionally, the metals used in the fabrication of seat frame 131 and seat attachment rail 172A may be treated through annealing, case hardening, precipitation strengthening, tempering, normalizing, and/or quenching in order to increase hardness, toughness, and tensile and shear strength.

Alternatively, seat attachment rail 172A may not form a continuous piece with seat frame 131 and, as such, may be a separate component. In such instances, seat attachment rail 172A may be made of either the same material as that of seat frame 131, or may be made of a different material. In either event, seat attachment rail 172A may be attached to seat frame 131 via adhesion, welding, mechanical fastening (e.g., nut and bolt), and the like.

Seat attachment rail 172A may include rib engagement channels and a plurality of side attachment holes. For example, as shown in FIG. 4B, seat attachment rail 172A may include rib engagement channels 175A and side attachment holes 174A. Rib engagement channels 175A may run along the entirety of the length of seat attachment rail 172A. Rib engagement channels 175A may be configured to support side ribs 185A and flanges 191A of seat 130. A plurality of side attachment holes 174A may be positioned on the rib engagement channels 175A. Each of the side attachment holes 174A may be configured to receive a side attachment screw interface 184A of seat 130. While five side attachment holes 174A are depicted in FIG. 4B, a fewer number (e.g., one, two, three, or four) or a greater number (six, ten, etc.) of side attachment holes 174A may be included.

Referring to FIG. 4A, seat 130 may be composed of any of a number of materials including, but not limited to, armored fabric cloth, sail fabric, awning fabric, Kevlar, tarp canvas, vinyl coated polyester, nylon mesh, neoprene, aluminized nylon, and/or cotton canvas. In some embodiments, the material may be treated to provide increased UV stabilization and weathering resistance, fire-resistance, abrasion and tear resistance, and waterproofing.

The material used in the fabrication of seat 130 may be manufactured in a highly-permeable, weave-type and/or mesh-like construction and, as such, may provide for increased load capacity and user comfort. The perimeter of the weave-type and/or mesh-like fabric construction of seat 130 may be configured to interface with seat frame border 183, which may be a rigid thermoplastic over-mold. In forming the interface between seat 130 and seat frame border 183, seat frame border 183 may be over-molded onto seat 130 through a method of local injection molding. The process may form a thermoplastic feature (e.g., seat frame border 183 and components included therein) through the fabric weave along the perimeter of seat 130. After the method of local injection molding is completed, the weave-type and/or mesh-like fabric construction of seat 130 may be taut and the seat frame border 183 may be rigidly attached to seat 130. Such an attachment method may eliminate stitching in the seat fabric and, by extension, offer advantages including repeatability, durability, dimensional accuracy, frame attachment flexibility and improved aesthetics.

Seat frame border 183 may include a plurality of protrusions of various types configured to aide and/or facilitate the engagement between seat 130 and seat frame 131. In particular, seat frame border 183 may include front attachment clips 187, 187A, and 187B, seat frame corner engagement faces 189A and 189B, side attachment screw interfaces 184A and 184B, side ribs 185A and 185B, flanges 191A and 191B, and back bar groove 196.

Seat 130 may be configured to be removably attached and/or engaged with seat frame 131. In forming the removable attachment and/or engagement, the various protrusions of seat frame border 183 of seat 130 may be configured to removably connect, insert, and/or interface with specific aspects of front handle 172 and seat attachment rails 172A and 172B. For example, front attachment clips 187, 187A, and 187B and side attachment screw interfaces 184A and 184B of seat frame border 183 may be respectively configured to be removably connected, inserted, and/or interfaced with front attachment holes 177, 177A, and 177B of carrying handle 172 and side attachment holes 174A and 174B of seat attachment rails 172A and 172B. Additionally, seat frame corner engagement faces 189A and 189B and back bar groove 196 of seat frame border 183 of seat 130 may be respectively configured to removably interface with seat frame corners 179A and 179B of seat frame 131 and back bar 197.

Further, side ribs 185A and 185B and flanges 191A and 191B of seat frame border 183 of seat 130 may be configured to removably interface with rib engagement channels 175A and 175B of seat attachment rails 172A and 172B. Side ribs 185A, 185B may be load carrying ribs and may be configured to interface with rib engagement channels 175A, 175B of seat attachment rails 172A, 172B. The side ribs 185A, 185B may extend from a bottom surface of a right and left side of the seat frame border 183 and flanges 191A, 191B may be located on each side of the seat frame border 183. The series of flanges 191A, 191B can extend perpendicular to a bottom surface of the seat frame border 183 and an outer face of the side ribs 175A, 175B. The side ribs 185A, 185B and the series of flanges 191A, 191B can prevent the side ribs from twisting when the seat is loaded. As such, the side ribs 185A, 185B and the flanges 191A, 191B may relieve structural loading from the side attachment screw interfaces 184A, 184B when seat 130 and seat frame 131 are in either of an attached or detached state and may also provide a complimentary force to that provided by side attachment screw interfaces 184A, 184B in a state in which seat 130 is attached to seat frame 131. In an attached stated, the side ribs 185A, 185B may traverse the length of seat attachment rails 172A, 172B and the flanges 191A, 191B may span the horizontal area of the seat attachment rails 172A, 172B. The number of flanges 191A, 191B can be selected based on the desired threshold loading of the chair, the thickness of each flange, and the weight distribution of the chair.

Figure 4C:
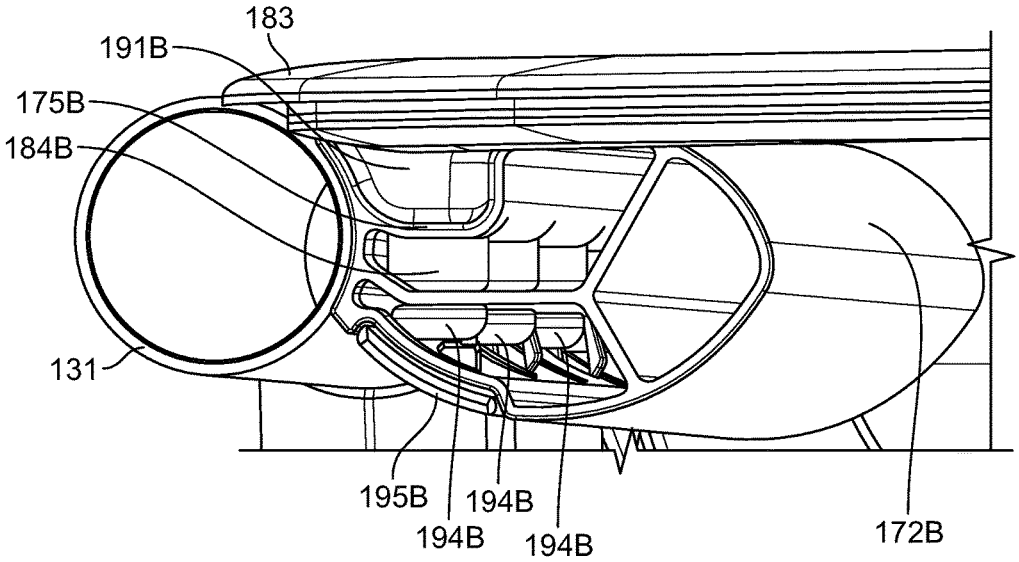
Figure 4D:
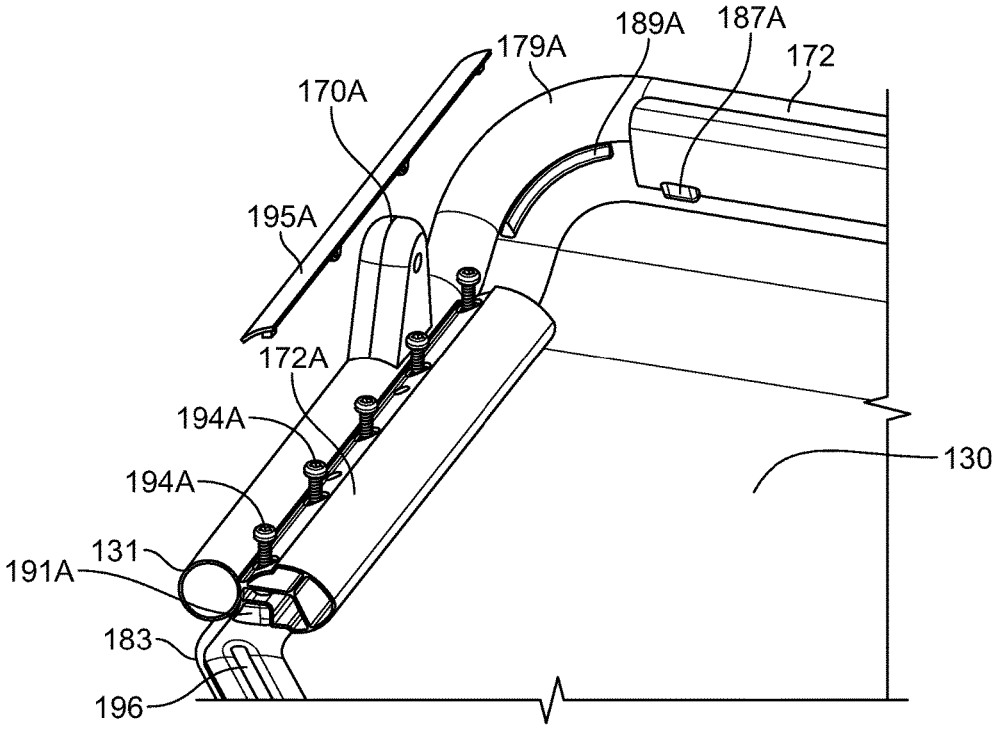

Referring in greater detail to FIGS. 4C and 4D, side attachment screw interface 184B may be configured to be inserted through side attachment hole 174B during the formation of the removable attachment between seat 130 and seat frame 131. Side attachment screw interface 184B may be configured to receive screw 194B in order to fasten seat 130 to seat frame 131. For instance, side attachment screw interface 184B may be inserted through side attachment hole 174B. Screw access panel 195B may be removed from side rail 172B to expose side attachment screw interface 184B. After removal of screw access panel 195B, screw 194B may be rotatably inserted into side attachment screw interface 184B. Similarly, screws 194B may be rotatably inserted into each of the side attachment screw interfaces 184B. After each of the screws 194B have been inserted into the side attachment screw interfaces 184B, the screw access panel 195B may be reattached to side attachment rail 172B. A similar process may be performed for side attachment screw interfaces 184A, side attachment holes 178A, screw access panel 195A, and screws 195A.

In the manner described above, seat 130, by way of seat frame border 183 and the plurality of protrusions formed thereto, may be configured to engage with the side attachment rails 172A and 172B and carrying handle 172 of seat frame 131. In some instances, the seat frame border 183 may be secured to seat frame 131 by locating a first end (e.g., front portion) of seat frame border 183 into a first end (e.g., front portion) of the seat frame 131 and rolling and/or flexing the seat frame border 183 from the first end of the seat frame 131 to a second end (e.g., back portion) of the seat frame 131. The rolling and/or flexing of the seat frame border 183 from the first end of the seat frame 131 to the second end may cause the plurality of protrusions of the seat frame border 183 to align with the plurality of slots in the seat attachment rails and to removeably attach the seat frame border 183 on the seat frame 131.

Alternatively, seat frame border 183 may be secured to seat frame 131 by inserting the rearmost side attachment screw interface 184B on the left side of the seat frame border 183 into the rearmost side attachment hole 174B of the left side attachment rail 172B and inserting the rearmost side attachment screw interface 184A on the right side of the seat frame border 183 into the rearmost side attachment hole 174A of the right side attachment rail 172A. Next, the first, second, and third middle side attachment screw interfaces 184B on the left side of the seat frame border 183 may be inserted into the first, second, and third middle side attachment holes 174B of the left side attachment rail 172B. Similarly, the first, second, and third middle side attachment screw interfaces 184A on the right side of the seat frame border 183 may be inserted into the first, second, and third middle side attachment holes 174A of the right side attachment rail 172A. Subsequently, the frontmost side attachment screw interface 184B on the left side of the seat frame border 183 may be inserted into the frontmost side attachment hole 174B of the left side attachment rail 172B and the frontmost side attachment screw interface 184A on the right side of the seat frame border 183 may be inserted into the frontmost side attachment hole 174A of the right side attachment rail 172A. Then, the seat 130, by way of the seat frame border 183, may be rolled and/or flexed at a front portion of the seat 130 in a downward direction to align and insert the front attachment clips 187, 187A, and 187B of the seat frame border 183 with the front attachment holes 177, 177A, and 177B of the carrying handle 172 and the front attachment clip on the right side of the seat frame border 183 with the front attachment hole on the right end portion of the carrying handle 172. Next, the screw access panels 195A and 195B may be removed from the side attachment rails 172A and 172B, and each of the screws 194A and 194B may be threaded into the respective side attachment screw interfaces 184A and 184B. After insertion, the screw access panels 195A and 195B may be reattached to side attachment rails 172A and 172B.

During the assembly of the seat frame border 183 to the seat frame 131, the seat frame border 183 can be rolled from a rear end to a front end. While such steps are described in a specific order from rear to front, the steps need not be performed in such an order and may be performed in any specific order.

Furthermore, in the state in which seat 130 is attached to seat frame 131, as shown in FIG. 4C, seat frame border 183 may interface with an outer portion of seat frame 131. In some instances, seat frame border 183 may be machined after the injection molding process described above in order to allow for cosmetic control of the seat frame border-seat frame interface.

Second Embodiment of Seat/Seat Frame Engagement

Figure 5A:
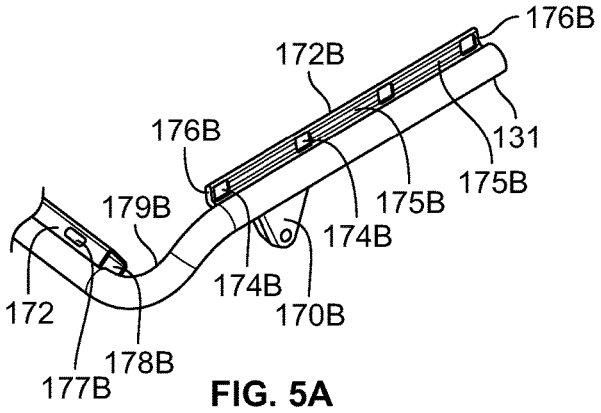
FIGS. 5A, 5B, 5C, 5D, and 5E respectively illustrate a front prospective view of a second example seat frame, a front prospective view of a second example seat, an underside prospective view of the second example seat, a sectional view of the second example seat engaged with the second example seat frame, and a front prospective view of the second example seat engaged with the second example seat frame of the example portable chair of FIG. 1 according to one or more aspects described herein.
Figure 5B:
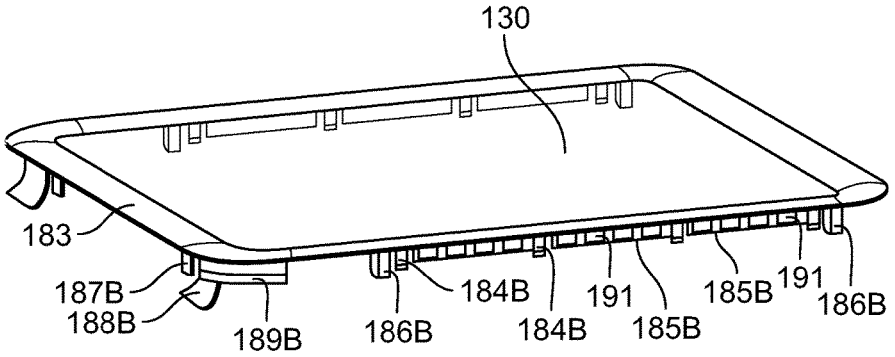
Figure 5C:
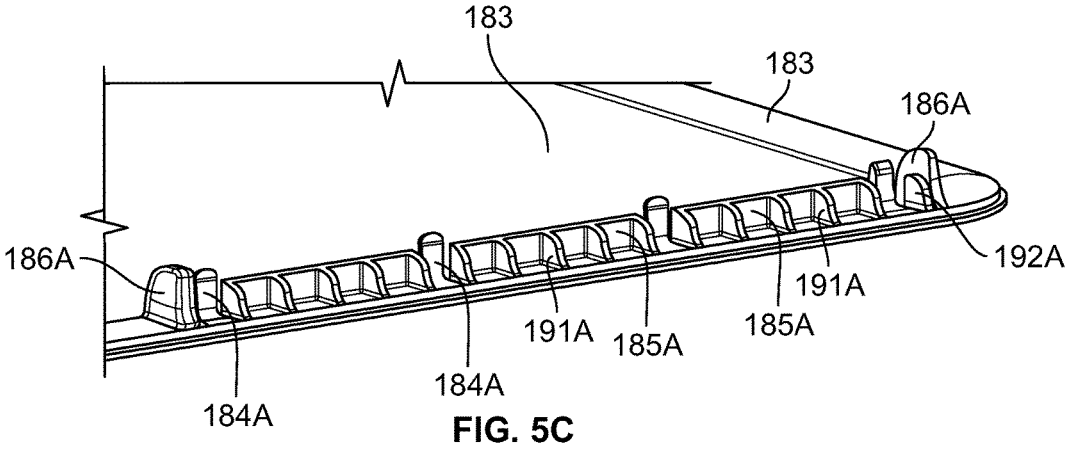

According to a second embodiment of the seat/seat frame engagement and as shown in FIG. 5A, carrying handle 172 may include front attachment hole 177B and side opening 178B on a first side of carrying handle 172 (e.g., left side of carrying handle 172), front attachment hole 177A and side opening 178A on a second side of carrying handle 172 (e.g., right side of carrying handle 172), and front attachment hole 177 on a third side of carrying handle 172 (e.g., center of carrying handle 172). As will be described in further detail below, front attachment hole 177B and side opening 178B may be configured to engage with front attachment clip 187B and carrying handle side cover 188B, respectively, of seat 130 as shown in FIG. 5B. As noted above, the components (e.g., carrying handle 172) of chair 100 which extend from the left side to the right side of chair 100 may be of a symmetric construction. Thus, carrying handle 172 may further include a front seat attachment hole and side opening on a second side of carrying handle 172 (e.g., right side of carrying handle 172) of an orientation and construction similar to that of front seat attachment hole 177B and side opening 178B.

Returning to FIG. 5A, seat frame 131 may also include seat attachment rail 172B. Seat attachment rail 172B may be positioned on an inner face of a side portion of seat frame 131 proximate to arm rest 150B, front leg 112B, and the like. Seat attachment rail 172B may be made of the same material as that of seat frame 131 (e.g., aluminum, titanium, stainless steel, scandium, metal alloys, carbon fiber, and/or bamboo). As such, seat attachment rail 172B may be manufactured as a continuous piece of seat frame 131. Thus, in instances in which aluminum, titanium, stainless steel, scandium, and/or metal alloys are used in the fabrication of seat frame 131 and seat attachment rail 172B, the material may be hydroformed and vacuum casted and into seat frame 131 and seat attachment rail 172B and may be treated through anodizing, plating, painting, powder coating, and/or the application of enamel in order to prevent corrosion induced by environmental conditions such as salt spray. Additionally, the metals used in the fabrication of seat frame 131 and seat attachment rail 172B may be treated through annealing, case hardening, precipitation strengthening, tempering, normalizing, and/or quenching in order to increase hardness, toughness, and tensile and shear strength.

Alternatively, seat attachment rail 172B may not form a continuous piece with seat frame 131 and, as such, may be a separate component. In such instances, seat attachment rail 172B may be made of either the same material as that of seat frame 131, or may be made of a different material. In either event, seat attachment rail 172B may be attached to seat frame 131 via adhesion, welding, mechanical fastening (e.g., nut and bolt), and the like.

Seat attachment rail 172B may include side openings, rib engagement channels, and a plurality of side attachment holes. For example, as shown in FIG. 5A, seat attachment rail 172B may include side openings 176B (e.g., distal and proximal side openings), rib engagement channels 175B, and side attachment holes 174B. Side openings 176B may provide openings through which the interior and/or internal portion of seat attachment rail 172B may be accessed. The side openings 176B may be configured to be covered by seat attachment rail side covers 186B of seat 130. The rail side covers 186 may be provided with integral ribs 192 to provide additional support of the seat frame border. Rib engagement channels 175B may run along the entirety of the length of seat attachment rail 172B from the first side opening 176B (e.g., distal side opening furthest from back 140) to the second side opening 176B (e.g., proximal side opening closest to back 140) along a line parallel to the face of seat frame 131 on which seat attachment rail 172B is attached. Rib engagement channels 175B may be configured to support side ribs 185B of seat 130. A plurality of side attachment holes 174B may be positioned on the rib engagement channels 175B. Each of the side attachment holes 174B may be configured to receive a side attachment clip 184B of seat 130. While four side attachment holes 174B are depicted in FIG. 4B, a fewer number (e.g., one, two, or three) or a greater number (five, six, ten, etc.) of side attachment holes 174B may be included. Seat frame 131 may further include an additional seat attachment rail that is positioned on the opposite inner face of the opposite side portion of seat frame 131 to that of seat attachment rail 172B. The additional seat attachment rail may be similar to that of seat attachment rail 172B.

Referring to FIG. 5B, seat frame border 183 may include a plurality of protrusions of various types configured to aide and/or facilitate the engagement between seat 130 and seat frame 131. In particular, seat frame border 183 may include front attachment clip 187B, carrying handle side cover 188B, seat frame corner engagement face 189B, seat attachment rail side covers 186B, side attachment clips 184B, and side ribs 185B. Each of such protrusions may be positioned on the left side of seat 130 and may be proximate to front leg 112B, arm rest 150B, and the like in a state in which seat 130 is engaged with seat frame 131. Furthermore, seat 130 may additionally include a front attachment clip, carrying handle side cover, seat frame corner engagement faces, seat attachment rail side covers, side attachment clips, and side ribs on the right side of seat 130. Such protrusions may be similar to those on the left side of seat 130 (e.g., front attachment clip 187B, carrying handle side cover 188B, seat frame corner engagement face 189B, etc.) but at a mirrored orientation on the right side of seat 130. As such, in a state in which seat 130 is engaged with seat frame 131, such protrusions on the right side of seat 130 may be proximate to front leg 112A, arm rest 150A, and the like.

Seat 130 may be configured to be removably attached and/or engaged with seat frame 131. In forming the removable attachment and/or engagement, the various protrusions of seat frame border 183 of seat 130 may be configured to removably connect and/or interface with specific aspects of front handle 172 and seat attachment rail 172B. For example, front attachment clip 187B and side attachment clips 184B of seat frame border 183 may be configured, respectively, to be removably connected and/or interfaced with front attachment hole 177B of carrying handle 172 and side attachment holes 174B of seat attachment rail 172B of seat frame 131. Further, carrying handle side cover 188B and seat attachment rail side covers 186B of seat frame border 183 of seat 130 may be configured, respectively, to removably interface with side openings 178B of carrying handle 172 and side openings 176B of seat attachment rail 172B of seat frame 131. Additionally, seat frame corner engagement face 189B and side ribs 185B of seat frame border 183 of seat 130 may be configured, respectively, to removably interface with seat frame corner 179B of seat frame 131 and rib engagement channel 175B of seat attachment rail 172B. The aforementioned connections and/or interfacings may occur on the left side of chair 100. In a state in which seat 130 is removably attached and/or engaged with seat frame 131, such connections and/or interfacings may be proximate to front leg 112B, arm rest 150B, and the like.

Similarly, the front attachment clip, carrying handle side cover, seat frame corner engagement face, seat attachment rail side covers, side attachment clips, and side ribs on the right side of the seat frame border 183 of seat 130 may be configured to removably connect and/or interface with the front seat attachment hole and side opening on the right side of carrying handle 172, the seat frame corner on the right side of seat frame 131, and the side openings, rib engagement channel, and plurality of side attachment holes of the seat attachment rail on the right side of seat frame 131 in the manner described above.

Figure 5D:
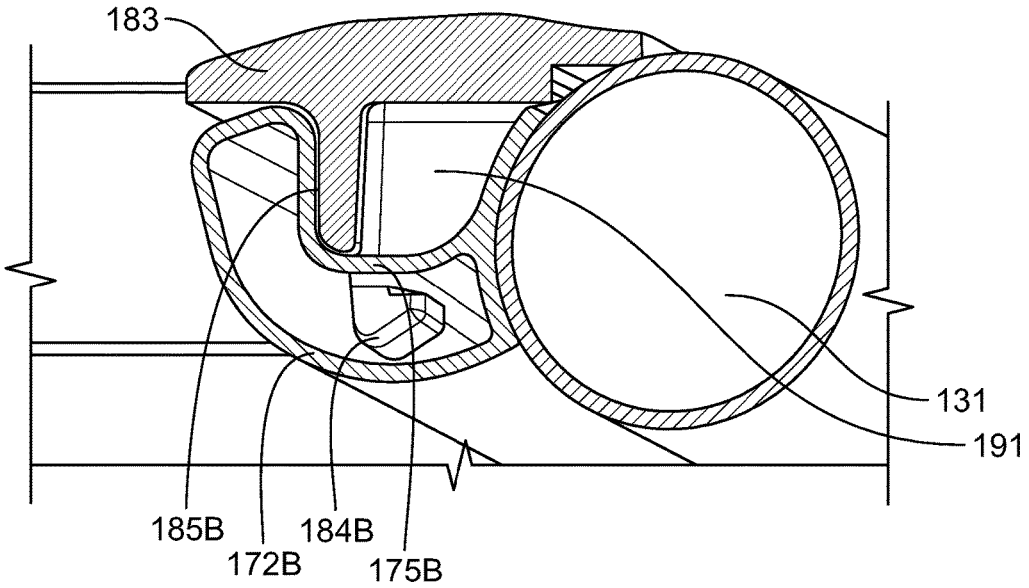
Figure 5E:
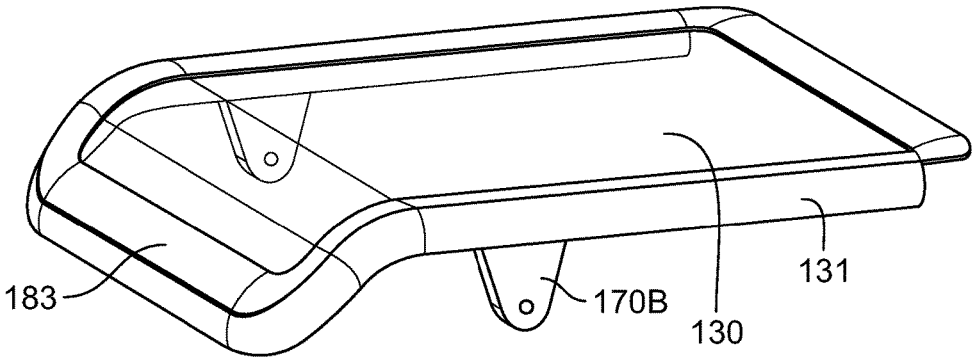

Referring in greater detail to FIG. 5D, side attachment clip 184B may be configured to be inserted through side attachment hole 174B during the formation of the removable attachment between seat 130 and seat frame 131. Side attachment clip 184B may have an extended rectangular construct with a half-arrow shaped distal end, which may allow for rotational pliability during insertion and removal, as well as for vertical force distribution during engagement. For instance, during insertion into side attachment hole 174B, a rotational force may be applied to the outer face of the half-arrow terminal end of side attachment clip 184B. In response to the rotational force, side attachment clip 184B may be configured to rotatably displace and allow for the insertion of side attachment clip 184B into side attachment hole 174B. After insertion has been completed and the rotational force has been removed, the side attachment clip 184B may be configured to return to a static position and an upper and/or overhang face of the half-arrow portion of side attachment clip 184B may be configured to interface with a bottommost face of rib engagement channel 175B of seat attachment rail 172B. Such an interface provided by side attachment clip 184B, in combination with the other side and front attachment clips, may provide for the removable attachment of seat 130 to seat 131.

Side ribs 185A, 185B may be load carrying ribs and may be configured to interface with rib engagement channels 175A, 175B of seat attachment rails 172A, 172B. The side ribs 185A, 185B may extend from a bottom surface of a right and left side of the seat frame border 183 and a series of flanges 191 may be located on each side of the seat frame border 183. The series of flanges 191 can extend perpendicular to a bottom surface of the seat frame border 183. The series of flanges 191 and the bottom surface of the seat frame border 183 can prevent the side ribs from twisting when the seat is loaded. As such, the side ribs 185A, 185B and the flanges 191 may relieve structural loading from the side attachment clips 184A, 184B and the other side attachment clips during use when seat 130 and seat frame 131 are in either of an attached or detached state and may also provide a complimentary force to that provided by side attachment clips 184A, 184B in a state in which seat 130 is attached to seat frame 131. The number of side ribs 185 can be selected based on the desired threshold loading of the chair, the thickness of each side rib, and the weight distribution of the chair. Additionally, it is also contemplated that the side ribs can be formed of an integral extending rib running the length of the channel of the attachment rails 175A, 175B.

In the manner described above, seat 130, by way of seat frame border 183 and the plurality of protrusions formed thereto, may be configured to engage with the side attachment rails and carrying handle 172 of seat frame 131. In particular, the seat frame border 183 may be secured to seat frame 131 by locating a first end (e.g., front portion) of seat frame border 183 into a first end (e.g., front portion) of the seat frame 131 and rolling and/or flexing the seat frame border 183 from the first end of the seat frame 131 to a second end (e.g., back portion) of the seat frame 131. The rolling and/or flexing of the seat frame border 183 from the first end of the seat frame 131 to the second end may cause the plurality of protrusions of the seat frame border 183 to align with the plurality of slots in the seat attachment rails and to removeably attach the seat frame border 183 on the seat frame 131.

Alternatively, seat frame border 183 may be secured to seat frame 131 by inserting the rearmost side attachment clip 186B on the left side of the seat frame border 183 into the rearmost side attachment hole 176B of the left side attachment rail 172B and inserting the rearmost side attachment clip on the right side of the seat frame border 183 into the rearmost side attachment hole of the right side attachment rail. Next, the first middle side attachment clip 186B and the second middle side attachment clip 186B on the left side of the seat frame border 183 may be inserted into the first middle side attachment hole 176B and the second middle side attachment hole 176B of the left side attachment rail 172B and the first middle side attachment clip and the second middle side attachment clip on the right side of the seat frame border 183 may be inserted into the first middle side attachment hole and the second middle side attachment hole of the right side attachment rail. Subsequently, the frontmost side attachment clip 186B on the left side of the seat frame border 183 may be inserted into the frontmost side attachment hole 176B of the left side attachment rail 176B and the frontmost side attachment clip on the right side of the seat frame border 183 may be inserted into the frontmost side attachment hole of the right side attachment rail. Then, the seat 130, by way of the seat frame border 183, may be rolled and/or flexed at a front portion of the seat 130 in a downward direction to align the front attachment clip 187B on the left side of the seat frame border 183 with the front attachment hole 177B on the left end portion of the carrying handle 172 and the front attachment clip on the right side of the seat frame border 183 with the front attachment hole on the right end portion of the carrying handle 183. Next, the front attachment clip 187B on the left side of the seat frame border 183 may be inserted into the front attachment hole 177B on the left end portion of the carrying handle 172 and the front attachment clip on the right side of the seat frame border 183 may be inserted into the front attachment hole on the right end portion of the carrying handle 172.

During the assembly of the seat frame border 183 with the seat frame 131, the seat frame border 183 can be rolled from a rear end to a front end. While such steps are described in a specific order from rear to front, the steps need not be performed in such an order and may be performed in any specific order.

Back and Back Frame

In conjunction with seat 130, portable chair 100 may include back 140, which may be removably attached to back frame 141. Back frame 141 may be a cylindrical rod, tube, shaft, and/or extrusion I-beam and may be made of aluminum, titanium, stainless steel, scandium, metal alloys, carbon fiber, and/or bamboo. In instances in which aluminum, titanium, stainless steel, scandium, and/or metal alloys are used in the fabrication of back frame 141, the material may be hydroformed and vacuum casted and may be treated through anodizing, plating, painting, powder coating, and/or the application of enamel in order to prevent corrosion induced by environmental conditions such as salt spray. Additionally, the metals used in the fabrication of back frame 141 may be treated through annealing, case hardening, precipitation strengthening, tempering, normalizing, and/or quenching in order to increase hardness, toughness, and tensile and shear strength.

Back frame 141 may include arm rest attachment portions, which may be configured to facilitate the rotatable attachment of back frame 141 to arm rests 150A and 150B by way of pins including pin 157B. Additionally, back frame 141 may intersect with back joinery interfaces 143A and 143B. In particular, back joinery interfaces 143A and 143B may include tubular terminations onto which back frame 141 may be configured to be inserted. Before, during, or after insertion, a binding agent and/or structural adhesive may be applied to the tubular terminations of back joinery interfaces 143A and 143B and/or terminal ends of back frame 141 to secure the back frame 141 to the back joinery interfaces 143A and 143B.

In a manner similar to that described above in regard to seat frame 131, back frame 141 may include a carrying handle and one or more back attachment rails. For example, as shown in FIG. 6B, carrying handle 272 may include top attachment hole 277B on a first side of carrying handle 272 (e.g., left side of carrying handle 272), top attachment hole 277A on a second side of carrying handle 272 (e.g., right side of carrying handle 172), and top attachment hole 277 on a third side of carrying handle 272 (e.g., center of carrying handle 272). As will be described in further detail below, top attachment holes 277, 277A, and 277B may be respectively configured to engage with top attachment clips 287, 287A, and 287B of back 140.

Furthermore, back frame 141 may also include back attachment rail 272B. Back attachment rail 272B may be positioned on an inner face of a side portion of back frame 141 proximate to arm rest 150B, front leg 112B, and the like. Back attachment rail 272B may be made of the same material as that of back frame 141 (e.g., aluminum, titanium, stainless steel, scandium, metal alloys, carbon fiber, and/or bamboo). As such, back attachment rail 272B may be manufactured as a continuous piece of back frame 141. Thus, in instances in which aluminum, titanium, stainless steel, scandium, and/or metal alloys are used in the fabrication of back frame 141 and back attachment rail 272B, the material may be hydroformed and vacuum casted and into back frame 141 and back attachment rail 272B and may be treated through anodizing, plating, painting, powder coating, and/or the application of enamel in order to prevent corrosion induced by environmental conditions such as salt spray. Additionally, the metals used in the fabrication of back frame 141 and back attachment rail 272B may be treated through annealing, case hardening, precipitation strengthening, tempering, normalizing, and/or quenching in order to increase hardness, toughness, and tensile and shear strength.

Alternatively, back attachment rail 272B may not form a continuous piece with back frame 141 and, as such, may be a separate component. In such instances, back attachment rail 272B may be made of either the same material as that of back frame 141, or may be made of a different material. In either event, back attachment rail 272B may be attached to back frame 141 via adhesion, welding, mechanical fastening (e.g., nut and bolt), and the like.

Back attachment rail 272B may include rib engagement channels and a plurality of side attachment holes. For example, as shown in FIG. 6B, back attachment rail 272B may include rib engagement channels 275B and side attachment holes 274B. Rib engagement channels 275B may run along the entirety of the length of back attachment rail 272B. Rib engagement channels 275B may be configured to support side ribs 285B and flanges 291B of back 140. A plurality of side attachment holes 274B may be positioned on the rib engagement channels 275B. Each of the side attachment holes 274B may be configured to receive a side attachment screw interface 284B of back 140. While five side attachment holes 274B are depicted in FIG. 6B, a fewer number (e.g., one, two, three, or four) or a greater number (six, ten, etc.) of side attachment holes 274B may be included.

Back frame 141 may also include back attachment rail 272A. Back attachment rail 272A may be positioned on an inner face of a side portion of back frame 141 proximate to arm rest 150A, front leg 112A, and the like. Back attachment rail 272A may be made of the same material as that of back frame 141 (e.g., aluminum, titanium, stainless steel, scandium, metal alloys, carbon fiber, and/or bamboo). As such, back attachment rail 272A may be manufactured as a continuous piece of back frame 141. Thus, in instances in which aluminum, titanium, stainless steel, scandium, and/or metal alloys are used in the fabrication of back frame 141 and back attachment rail 272A, the material may be hydroformed and vacuum casted and into back frame 141 and back attachment rail 272A and may be treated through anodizing, plating, painting, powder coating, and/or the application of enamel in order to prevent corrosion induced by environmental conditions such as salt spray. Additionally, the metals used in the fabrication of back frame 141 and back attachment rail 272A may be treated through annealing, case hardening, precipitation strengthening, tempering, normalizing, and/or quenching in order to increase hardness, toughness, and tensile and shear strength.

Alternatively, back attachment rail 272A may not form a continuous piece with back frame 141 and, as such, may be a separate component. In such instances, back attachment rail 272A may be made of either the same material as that of back frame 141, or may be made of a different material. In either event, back attachment rail 272A may be attached to back frame 141 via adhesion, welding, mechanical fastening (e.g., nut and bolt), and the like.

Back attachment rail 272A may include rib engagement channels and a plurality of side attachment holes. For example, as shown in FIG. 6B, back attachment rail 272A may include rib engagement channels 275A and side attachment holes 274A. Rib engagement channels 275A may run along the entirety of the length of back attachment rail 272A. Rib engagement channels 275A may be configured to support side ribs 285A and flanges 291A of back 140. A plurality of side attachment holes 274A may be positioned on the rib engagement channels 275A. Each of the side attachment holes 274A may be configured to receive a side attachment screw interface 284A of back 140. While five side attachment holes 274A are depicted in FIG. 6B, a fewer number (e.g., one, two, three, or four) or a greater number (six, ten, etc.) of side attachment holes 274A may be included.

Figure 6A:
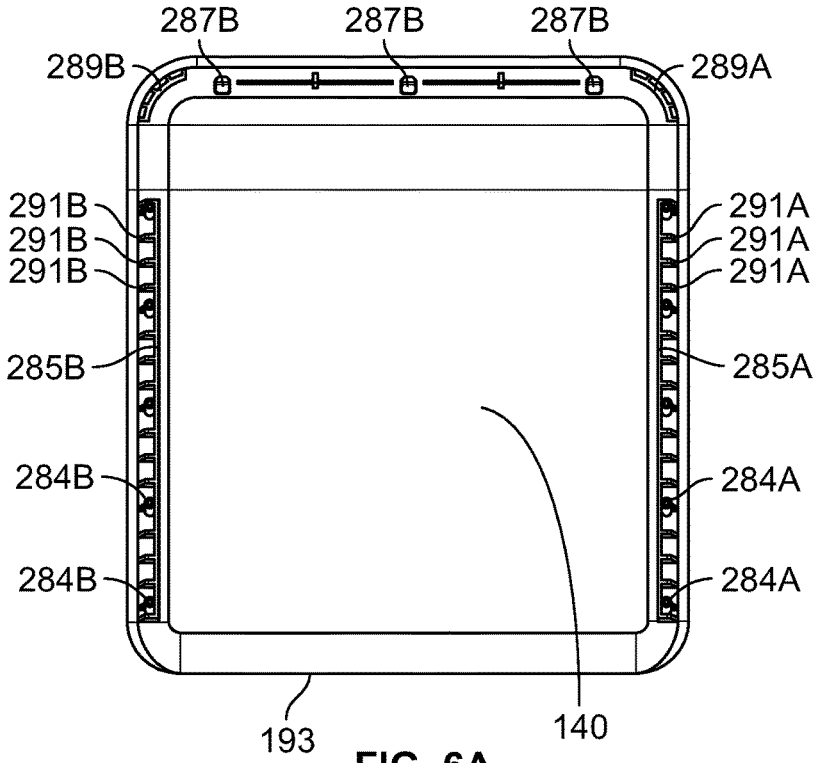
FIGS. 6A, 6B, and 6C respectively illustrate a rear view of an example back, a front view of an example back frame, and a sectional view of the example back engaged with the example back frame of the example portable chair of FIG. 1 according to one or more aspects described herein.
Figure 6B:
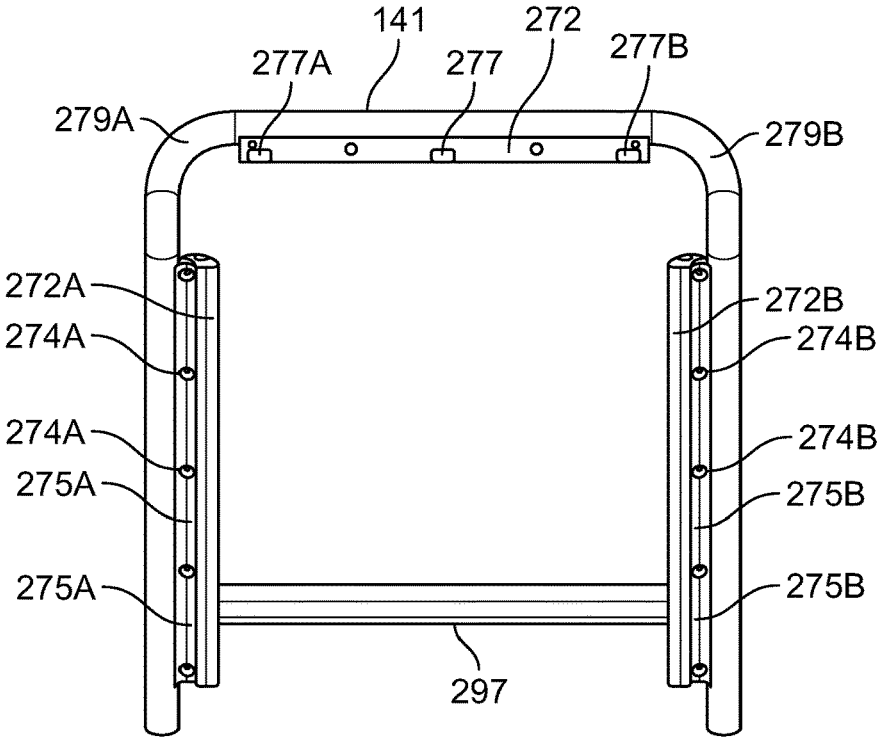

Referring to FIG. 6A, back 140 may be composed of any of a number of materials including, but not limited to, armored fabric cloth, sail fabric, awning fabric, Kevlar, tarp canvas, vinyl coated polyester, nylon mesh, neoprene, aluminized nylon, and/or cotton canvas. In some embodiments, the material may be treated to provide increased UV stabilization and weathering resistance, fire resistance, abrasion and tear resistance, and waterproofing.

In certain instances, back 140 may be composed of a similar material to that of seat 130. However, in some cases, the material used in the manufacture of back 140 may be different than that used in the manufacture of seat 130. For example, back 140 may be made of a first material and/or combination of materials, and seat 130 may be made of a second material and/or combination of materials different than the first material and/or combination of materials.

The material used in the fabrication of back 140 may be manufactured in a highly-permeable, weave-type and/or mesh-like construction and, as such, may provide for increased load capacity and user comfort. The perimeter of the weave-type and/or mesh-like fabric construction of back 140 may be configured to interface with back frame border 193, which may be a rigid thermoplastic over-mold. In forming the interface between back 140 and back frame border 193, back frame border 193 may be over-molded onto back 140 through a method of local injection molding. The process may form a thermoplastic feature (e.g., back frame border 193 and components included therein) through the fabric weave along the perimeter of back 140. After the method of local injection molding is completed, the weave-type and/or mesh-like fabric construction of back 140 may be taut and the back frame border 193 may be rigidly attached to back 140. Such an attachment method may eliminate stitching in the seat fabric and, by extension, offer advantages including repeatability, durability, dimensional accuracy, frame attachment flexibility and improved aesthetics.

Back frame border 193 may include a plurality of protrusions of various types configured to aide and/or facilitate the engagement between back 140 and back frame 141. In particular, back frame border 193 may include top attachment clips 287, 287A, and 287B, back frame corner engagement faces 289A and 289B, side attachment screw interfaces 284A and 284B, side ribs 285A and 285B, and flanges 291A and 291B.

Back 140 may be configured to be removably attached and/or engaged with seat frame 141. In forming the removable attachment and/or engagement, the various protrusions of back frame border 193 of back 140 may be configured to removably connect, insert, and/or interface with specific aspects of top handle 272 and back attachment rails 272A and 272B. For example, top attachment clips 287, 287A, and 287B and side attachment screw interfaces 284A and 284B of back at frame border 193 may be respectively configured to be removably connected, inserted, and/or interfaced with top attachment holes 277, 277A, and 277B of carrying handle 272 and side attachment holes 274A and 274B of back attachment rails 272A and 272B. Additionally, back frame corner engagement faces 289A and 289B of back frame border 283 of back 140 may be respectively configured to removably interface with back frame corners 279A and 279B of back frame 141.

Further, side ribs 285A and 285B and flanges 291A and 291B of back frame border 193 of back 140 may be configured to removably interface with rib engagement channels 275A and 275B of back attachment rails 272A and 272B. Side ribs 285A, 285B may be load carrying ribs and may be configured to interface with rib engagement channels 275A, 275B of back attachment rails 272A, 272B. The side ribs 285A, 285B may extend from a bottom surface of a right and left side of the back frame border 193 and flanges 291A, 291B may be located on each side of the back frame border 193. The series of flanges 291A, 291B can extend perpendicular to a bottom surface of the back frame border 193 and an outer face of the side ribs 275A, 275B. The side ribs 285A, 285B and the series of flanges 291A, 291B can prevent the side ribs from twisting when the back is loaded. As such, the side ribs 285A, 285B and the flanges 291A, 291B may relieve structural loading from the side attachment screw interfaces 284A, 284B when back 140 and back frame 141 are in either of an attached or detached state and may also provide a complimentary force to that provided by side attachment screw interfaces 284A, 284B in a state in which back 140 is attached to back frame 141. In an attached stated, the side ribs 285A, 285B may traverse the length of back attachment rails 272A, 272B and the flanges 291A, 291B may span the horizontal area of the back attachment rails 272A, 272B. The number of flanges 291A, 291B can be selected based on the desired threshold loading of the chair, the thickness of each flange, and the weight distribution of the chair.

Figure 6C:
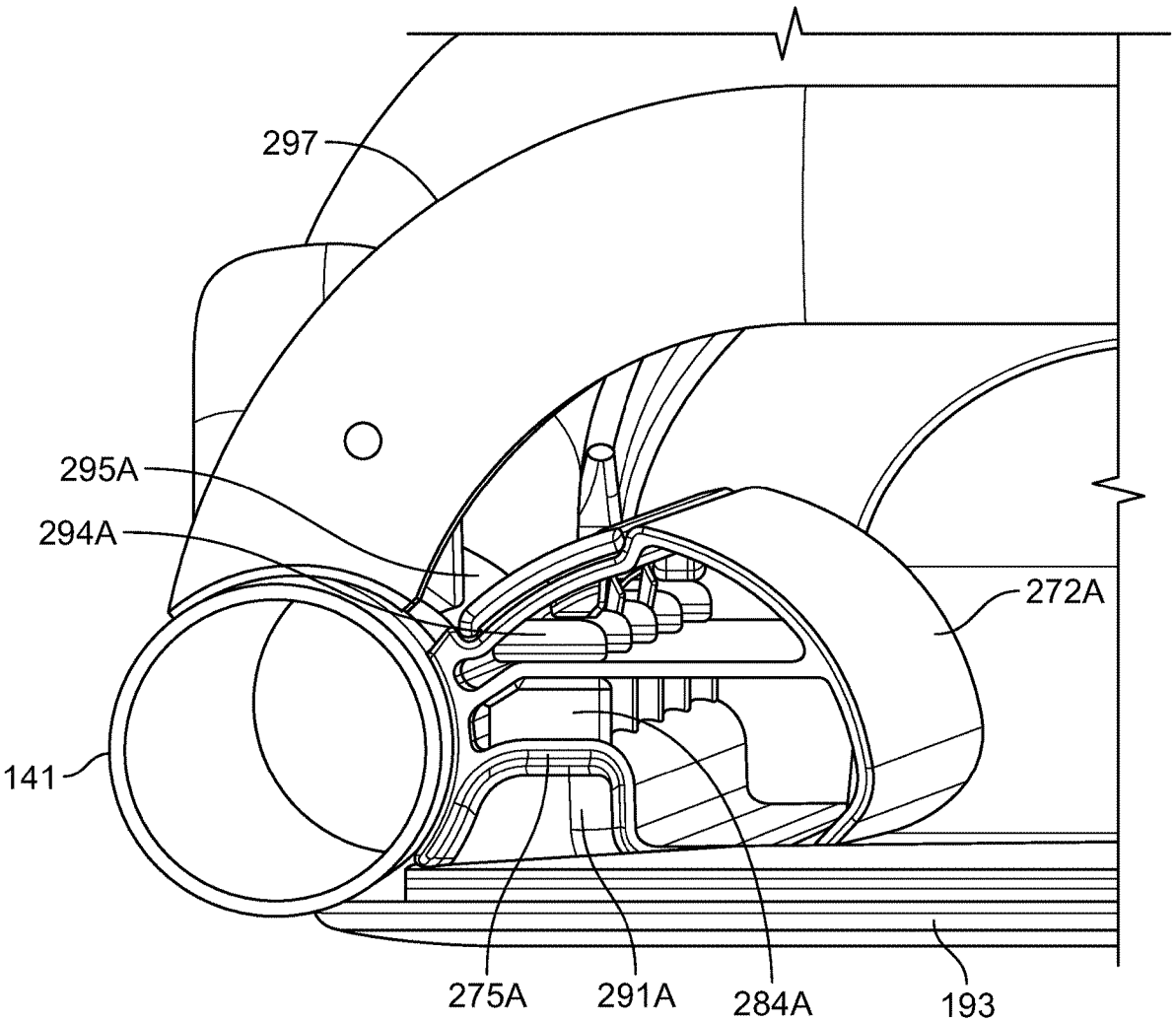

Referring to FIG. 6C, side attachment screw interface 284A may be configured to be inserted through side attachment hole 274A during the formation of the removable attachment between back 140 and back frame 141. Side attachment screw interface 284A may be configured to receive screw 294A in order to fasten back 140 to back frame 141. For instance, side attachment screw interface 284A may be inserted through side attachment hole 274A. Screw access panel 295A may be removed from side rail 272A to expose side attachment screw interface 284A. After removal of screw access panel 295A, screw 294A may be rotatably inserted into side attachment screw interface 284A. Similarly, screws 294A may be rotatably inserted into each of the side attachment screw interfaces 284A. After each of the screws 294A have been inserted into the side attachment screw interfaces 284A, the screw access panel 295A may be reattached to side attachment rail 272A. A similar process may be performed for side attachment screw interfaces 284B, side attachment holes 278B, screw access panel 295B, and screws 295B.

In the manner described above, back 140, by way of back frame border 193 and the plurality of protrusions formed thereto, may be configured to engage with the side attachment rails 272A and 272B and carrying handle 272 of back frame 141. In some instances, the back frame border 183 may be secured to back frame 141 by locating a first end (e.g., top portion) of back frame border 193 into a first end (e.g., top portion) of the back frame 141 and rolling and/or flexing the back frame border 193 from the first end of the back frame 141 to a second end (e.g., bottom portion) of the back frame 141. The rolling and/or flexing of the back frame border 193 from the first end of the back frame 141 to the second end may cause the plurality of protrusions of the back frame border 193 to align with the plurality of slots in the back attachment rails and to removeably attach the back frame border 193 on the back frame 141.

Alternatively, back frame border 193 may be secured to back frame 141 by inserting the bottommost side attachment screw interface 284B on the left side of the back frame border 193 into the bottommost side attachment hole 274B of the left side attachment rail 272B and inserting the bottommost side attachment screw interface 284A on the right side of the back frame border 193 into the bottommost side attachment hole 274A of the right side attachment rail 272A. Next, the first, second, and third middle side attachment screw interfaces 284B on the left side of the back frame border 193 may be inserted into the first, second, and third middle side attachment holes 274B of the left side attachment rail 272B. Similarly, the first, second, and third middle side attachment screw interfaces 284A on the right side of the back frame border 193 may be inserted into the first, second, and third middle side attachment holes 274A of the right side attachment rail 272A. Subsequently, the topmost side attachment screw interface 284B on the left side of the back frame border 193 may be inserted into the topmost side attachment hole 274B of the left side attachment rail 272B and the topmost side attachment screw interface 284A on the right side of the back frame border 193 may be inserted into the topmost side attachment hole 274A of the right side attachment rail 272A. Then, the back 140, by way of the back frame border 193, may be rolled and/or flexed at a top portion of the back 140 in a backward direction to align and insert the top attachment clips 287, 287A, and 287B of the back frame border 193 with the top attachment holes 277, 277A, and 277B of the carrying handle 272 and the top attachment clip on the right side of the back frame border 193 with the top attachment hole on the right end portion of the carrying handle 272. Next, the screw access panels 295A and 295B may be removed from the side attachment rails 272A and 272B, and each of the screws 294A and 294B may be threaded into the respective side attachment screw interfaces 284A and 284B. After insertion, the screw access panels 295A and 295B may be reattached to side attachment rails 272A and 272B.

In some instances, back frame border 193 may have a plurality of back attachment clips in the manner described above in regard to seat frame border 183 as opposed to the back attachment screw interfaces 284A. In such instances, the side attachment clip may be configured to be inserted through side attachment hole 274B during the formation of the removable attachment between back 140 and back frame 141. The side attachment clip may have an extended rectangular construct with a half-arrow shaped distal end, which may allow for rotational pliability during insertion and removal, as well as for vertical force distribution during engagement. For instance, during insertion into side attachment hole 274B, a rotational force may be applied to the outer face of the half-arrow terminal end of the side attachment clip. In response to the rotational force, the side attachment clip may be configured to rotatably displace and allow for the insertion of side attachment clip into side attachment hole 274B. After insertion has been completed and the rotational force has been removed, the side attachment clip may be configured to return to a static position and an upper and/or overhang face of the half-arrow portion of side attachment clip may be configured to interface with a bottommost face of rib engagement channel 275B of back attachment rail 272B. Such an interface provided by side attachment clip, in combination with the other side and top attachment clips, may provide for the removable attachment of back 140 to back 141.

In either instance, during the assembly of the back frame border 193 to the back frame 141, the back frame border 193 can be rolled from a bottom end to a top end. While such steps are described in a specific order from bottom to top, the steps need not be performed in such an order and may be performed in any specific order. Furthermore, in the state in which back 140 is attached to back frame 141, as shown in FIG. 6C, back frame border 193 may interface with an outer portion of back frame 141. In some instances, back frame border 193 may be machined after the injection molding process described above in order to allow for cosmetic control of the back frame border-back frame interface.

Arm Rests

Referring back to FIG. 1, portable chair 100 may also include arm rests 150A and 150B. The arm rests 150A and 150B may be pivotably attached to the arm rest attachment portions of back frame 141 via one or more pins including pin 157B. Arm rests 150A and 150B may be further configured to be attached, respectively, to front joinery interface 116A and back joinery interface 126A via pin 128A and front joinery interface 116B and back joinery interface 126B via pin 128B.

Arm rests 150A and 150B may be made of plastic, rubber, metal, carbon fiber, and the like and may be configured to support up to a 5001*b* load in one example. In some instances arm rests 150A and 150B may serve as buoyancy aides in preventing the submersion of portable chair 100. Similarly, in one example, arm rests 150A and 150B may be fabricated through a gas-assisted injection molding process to create a hollow cavity in the interior of the arm rests. Such a hollow cavity may serve as a buoyancy aide for chair 100.

Foldability

Figure 7A:
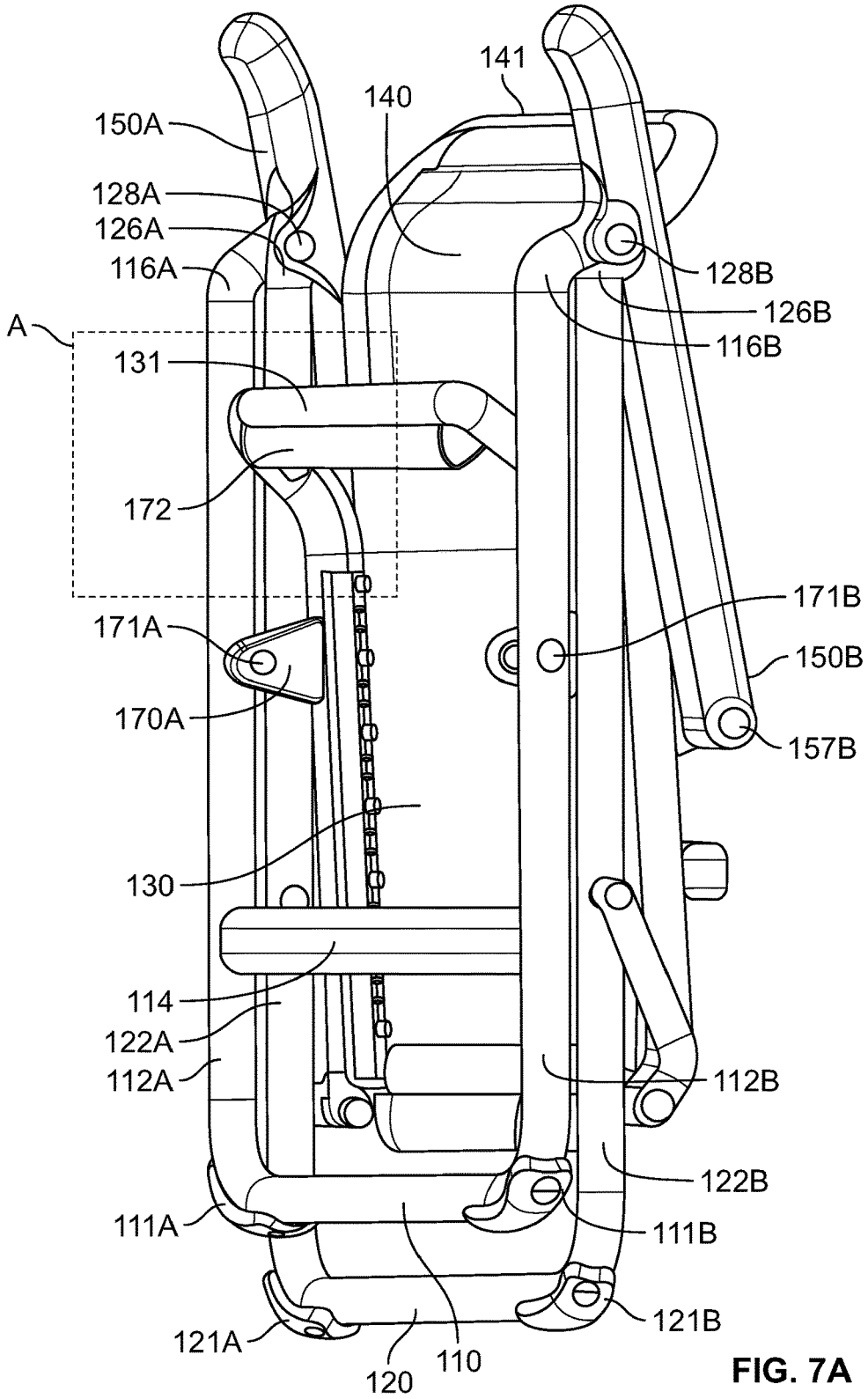
FIGS. 7A and 7B respectively illustrate a front prospective view and a section of the example portable chair of FIG. 1 in a folded configuration according to one or more aspects described herein.
Figure 7B:
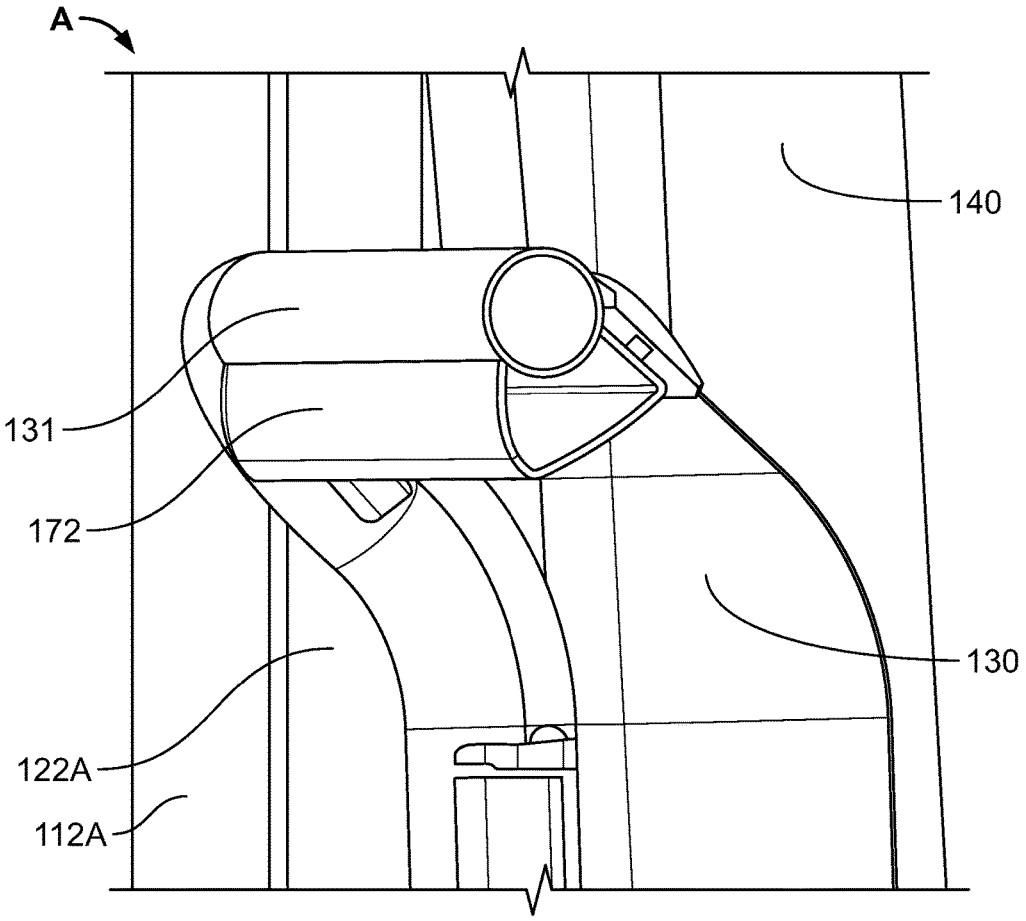

Referring to FIG. 7A, portable chair 100 may be a foldable and portable chair. Through actuation of the rotational and pivotable interfaces, portable chair 100 may be able to be folded into a portable arrangement and unfolded into a seating arrangement. While in the folded portable arrangement, the chair 100 may be locked and/or sustained in the folded portable arrangement by one or more detents. The one or more detents may provide resistance against the opening of the chair 100 from the folded portable arrangement into the unfolded seating arrangement. While in the unfolded seating arrangement, the one or more detents may additionally provide resistance against the closing of the chair 100 from the unfolded seating arrangement into the folded portable arrangement.

For further example, chair 100 may be configured to open from a folded portable arrangement into an unfolded seating arrangement. In the folded portable arrangement, the front legs 112A and 112B may be substantially parallel to back legs 122A and 122B and seat 130 may be substantially parallel to back 140. One or more detents may be included in the attachment interfaces between the seat joinery interfaces 133A and 133B of seat frame 131. Additionally and/or alternatively, the one or more detents may be included in the attachment interface between front leg attachment portions 170A and 170B and front legs 112A and 112B via pins 171A and 171B.

The one or more detents may provide resistance against the opening displacement of the front legs 112A and 112B and seat 130 away from back legs 122A and 122B and back 140 and, as such, may function to lock and/or maintain the chair in the folded portable arrangement. In addition to the resistance, the one or more detents may also provide intentional audible feedback to a user of chair 100 indicating that the chair 100 is in a locked position when an attempt is made to open the chair 100 from the folded portable arrangement to the unfolded seating arrangement.

While in the folded portable arrangement, when an opening force is applied to the chair 100 that is greater than the locking force and/or resistance provided by the one or more detents, chair 100 may become openable and the front legs 112A and 112B and seat 130 may rotatably displace from back legs 122A and 122B and back 140. At such a point, the chair 100 may be in an unlocked and transitory state between the folded portable arrangement and the unfolded seating arrangement. Upon the continued application of the opening force, the chair 100 may achieve a maximum opening displacement and arrive at the unfolded seating arrangement. At the unfolded seating arrangement, the front legs 112A and 112B and seat 130 may be angled relative to back legs 122A and 122B and back 140.

Additionally, the one or more detents included in the attachment interface between front leg attachment portions 170A and 170B and front legs 112A and 112B via pins 171A and 171B may provide resistance against the closing displacement of the front legs 112A and 112B and seat 130 towards back legs 122A and 122B and back 140. As such, the one or more detents may function to lock and/or maintain the chair 100 in the unfolded seating arrangement. In addition to the resistance, the one or more detents may also provide intentional audible feedback to a user of chair 100 indicating that the chair 100 is in a locked position when an attempt is made to close the chair 100 from the unfolded seating arrangement to the folded portable arrangement. While in the unfolded seating arrangement, when a closing force is applied to the chair 100 that is greater than the locking force and/or resistance provided by the one or more detents, the chair 100 may become closeable and the front legs 112A and 112B and seat 130 may rotatably displace towards back legs 122A and 122B and back 140.

Cup Holders

On the front leg 112A proximate to the intersection with the front leg attachment portion 170A of seat frame 131, which will be discussed in further detail below, chair 100 may include a cup holder (not shown). In some instances, the cup holder may be rigidly attached to the first front leg 112A, while in other instances the cup holder may be included in a detachably attachable accessory.

In either instance (e.g., rigidly attached or detachably attachable accessory) the cup holder may be configured to secure a cup, bottle, thermos, glass, can, mug, or drink container of any of a plurality of sizes. The cup holder may be a vacuum insulated cup holder or an aerogel cup holder and may be configured to maintain a temperature lower or higher than that of the ambient surrounding environment. The cup holder may be configured to cool an inserted drink container and/or maintain and prolong a period of below-ambient temperature of an inserted drink container. Additionally and/or alternatively, the cup holder may be configured to receive an ice pack and/or natural ice insert in order to aide in cooling of an inserted drink container and/or prolong a period of below-ambient temperature.

In one example, on the front leg 112A proximate to the intersection with the front leg attachment portion 170A of seat frame 131, chair 100 may include an accessory attachment interface (not shown). The accessory attachment interface may be fabricated into front leg 112A and may be configured to receive YETI® Tundra accessories including YETI® Beverage Holder, YETI® Rod Holster, YETI® Molle Zinger, and the like. Additionally, the accessory attachment interface may be configured to receive a waterproof storage compartment, anti-varmint device, fish finder, and the like.

Additionally and/or alternatively, on the front leg 112B proximate to the intersection with the front leg attachment portion 170B of seat frame 131, chair 100 may include a rigidly attached cup holder, a detachably attachable cup holder accessory, and/or an accessory attachment interface configured to receive YETI® Tundra accessories and additional accessories as stated above.

We claim:

1. A portable chair comprising:

a first front leg and a second front leg connected by a front sled;

a first back leg and a second back leg connected by a back sled;

a seat including a seat frame border, wherein the seat is of a highly-permeable, weave-type construction, and wherein the seat frame border is a rigid over-mold that is rigidly attached to the seat by an injection molding process;

wherein the injection molding process forms a plurality of protrusions on an underside portion of the seat frame border; and a seat frame including a first terminal end, a second terminal end, and a seat attachment rail, wherein the plurality of protrusions on the underside portion of the seat frame border are configured to removably engage with the seat attachment rail.

2. The portable chair of claim 1, wherein the seat frame further includes a carrying handle and wherein the carrying handle is configured to receive the seat frame border.

3. The portable chair of claim 1, wherein the seat frame further includes a seat handle comprising a side opening and wherein the seat frame border comprises a carrying handle side cover for covering the side opening.

4. The portable chair of claim 1, wherein the seat attachment rail comprises a plurality of slots configured to receive the plurality of protrusions and wherein the seat attachment rail further comprises a channel and the seat frame border further comprises a series of ribs and the channel supports the series of ribs, the ribs being configured to relieve loading of the plurality of protrusions on the seat frame border.

5. The portable chair of claim 4, wherein the plurality of protrusions each comprise a separate projection extending perpendicular to the plurality of slots when the plurality of protrusions are located in the plurality of slots in the seat attachment rail to lock the seat frame border to the seat frame.

6. The portable chair of claim 4, wherein the series of ribs are adjoined to a flange extending from the underside portion of the seat frame border.

7. The portable chair of claim 4, wherein the seat frame border is secured to the seat frame by locating a first end of the seat frame border into a first end of the seat frame and rolling and flexing the seat frame border from the first end of the seat frame to a second end of the seat frame causing the plurality of protrusions to align with the plurality of slots in the seat attachment rail to lock the seat frame border into place on the seat frame.

8. The portable chair of claim 4, wherein the plurality of protrusions each comprise a screw interface projection and wherein in a state in which the plurality of protrusions are inserted into the plurality of slots the seat frame border is secured to the seat frame by at least one screw inserted into at least one of the plurality of protrusions.

9. The portable chair of claim 1, further comprising:

a first front leg joinery interface including a tubular protrusion onto which the first front leg is configured to be inserted and welded onto and a first back leg joinery interface including a tubular protrusion onto which the first back leg is configured to be inserted and welded onto.

10. The portable chair of claim 9, further comprising:

a first arm rest configured to be rotatably fastened to the first front leg joinery interface and the first back leg joinery interface via a first front pin.

11. The portable chair of claim 9, further comprising:

a second front leg joinery interface including a tubular protrusion onto which the second front leg is configured to be inserted and welded onto; and a second back leg joinery interface including a tubular protrusion onto which the second back leg is configured to be inserted and welded onto.

12. The portable chair of claim 11, further comprising:

a second arm rest configured to be rotatably fastened to the second front leg joinery interface and the first back leg joinery interface via a second front pin.

13. The portable chair of claim 1, further comprising:

a back including a back frame border, wherein the back is of a highly-permeable, weave-type construction, and wherein the back frame border is a rigid over-mold that is rigidly attached to the back by an injection molding process;

wherein the injection molding process forms a plurality of protrusions on an backside portion of the back frame border; and a back frame including a first terminal end, a second terminal end, a first back attachment rail, and a second back attachment rail, wherein the plurality of protrusions on the backside portion of the back frame border are configured to removably engage with the first back attachment rail and the second back attachment rail.

14. The portable chair of claim 13, further comprising a first back joinery interface including a tubular protrusion onto which the first terminal end of the back frame is configured to be inserted and welded onto; and a second back joinery interface including a tubular protrusion onto which the second terminal end of the back frame is configured to be inserted and welded onto.

15. The portable chair of claim 14, further comprising:

a first seat joinery interface including a tubular protrusion onto which the first terminal end of the seat frame is configured to be inserted and welded onto; and a second seat joinery interface including a tubular protrusion onto which the second terminal end of the seat frame is configured to be inserted and welded onto.

16. The portable chair of claim 15, wherein each of the first front leg, second front leg, front sled, first back leg, second back leg, back sled, seat frame, and back frame are composed of hydroformed aluminum, and wherein the front sled includes a first front foot and a second front foot and the back sled includes a first back foot and a second back foot, and wherein each of the first front foot, second front foot, first back foot, and second back include a retention feature hole configured to allow water to drain from an interface between the foot associated with the retention feature hole and the particular sled on which the foot is attached.

17. A method comprising:

inserting a rearmost side attachment screw interface on a first side of a seat frame border attached to a seat by an injection molding process into a rearmost side attachment hole of a first side attachment rail attached to a seat frame and a rearmost side attachment screw interface on a second side of the seat frame border into a rearmost side attachment hole of a second side attachment rail attached to the seat frame;

inserting a first middle side attachment screw interface and a second middle side attachment screw interface on the first side of the seat frame border into a first middle side attachment hole and a second middle side attachment hole of the first side attachment rail and a first middle side attachment screw interface and a second middle side attachment screw interface on the second side of the seat frame border into a first middle side attachment hole and a second middle side attachment hole of the second side attachment rail;

inserting a frontmost side attachment screw interface on the first side of the seat frame border into a frontmost side attachment hole of the first side attachment rail and a frontmost side attachment clip on the second side of the seat frame border into a frontmost side attachment hole of the second side attachment rail;

aligning a front attachment clip on a third side of the seat frame border with a front attachment hole of on a first end portion of a carrying handle attached to the seat frame and a front attachment clip on the third side of the seat frame border with a front attachment hole on a second end portion of the carrying handle; and inserting the front attachment clip on the first side of the seat frame border into the front attachment hole on the first end portion of the carrying handle and the front attachment clip on the second side of the seat frame border into the front attachment hole on the second end portion of the carrying handle.

18. The method of claim 17, further comprising:

removing a screw access panel of the first side attachment rail and a screw access panel of the second side attachment rail; and inserting a screw into each of the rearmost side attachment screw interface, first middle side attachment screw interface, second middle side attachment screw interface, and frontmost side attachment screw interface on the first side of the seat frame border and a screw into each of the rearmost side attachment screw interface, first middle side attachment screw interface, second middle side attachment screw interface, and frontmost side attachment screw interface on the second side of the seat frame border to secure the seat to the seat frame.

19. The method of claim 18, wherein seat is rolled from a rear side to a front side during assembling the seat to the seat frame.

20. The method of claim 19, wherein the seat frame border, on the first side, includes a rear rib between the rearmost side attachment screw interface and the first middle side attachment screw interface, a middle rib between the first middle side attachment screw interface and the second middle side attachment screw interface, and a front rib between the second middle side attachment screw interface and the frontmost side attachment screw interface and, on the second side, includes a rear rib between the rearmost side attachment screw interface and the first middle side attachment screw interface, a middle rib between the first middle side attachment screw interface and the second middle side attachment screw interface, and a front rib between the second middle side attachment screw interface and the frontmost side attachment screw interface.

* * * * *